US006074048A

United States Patent [19]

Hotomi et al.

[11] Patent Number: 6,074,048

[45] **Date of Patent: *Jun. 13, 2000**

[54] INK JET RECORDING HEAD INCLUDING INTERENGAGING PIEZOELECTRIC AND NON-PIEZOELECTRIC MEMBERS AND METHOD OF MANUFACTURING SAME

[75] Inventors: Hideo Hotomi, Ibaraki; Osamu Ebisu, Toyonaka; Kenji Masaki, Nagaokakyou; Kusunoki Higashino, Osaka, all of Japan

[73] Assignee: Minolta Co., Ltd., Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/239,527

[22] Filed: May 9, 1994

[30] Foreign Application Priority Data

May 12, 1993 [JP] Japan ..... 5-110718
May 9, 1994 [JP] Japan ..... 6-095225

[51] Int. Cl.[7] ..... B41J 2/045

[52] U.S. Cl. ..... 347/71; 347/69

[58] Field of Search ..... 347/68, 69, 71, 347/94, 72; B41J 2/045

[56] References Cited

U.S. PATENT DOCUMENTS

| | | | |
|---|---|---|---|
| 4,115,789 | 9/1978 | Fischbeck | 347/68 |
| 4,752,788 | 6/1988 | Yasuhara et al. | 347/71 |
| 5,270,740 | 12/1993 | Naruse et al. | 347/72 |
| 5,373,314 | 12/1994 | Everett et al. | 347/71 |
| 5,446,485 | 8/1995 | Usui et al. | 347/72 |
| 5,477,249 | 12/1995 | Hotomi | 347/71 X |
| 5,477,253 | 12/1995 | Hotomi et al. | 347/71 |
| 5,677,717 | 10/1997 | Ohashi | 347/69 |

FOREIGN PATENT DOCUMENTS

| | | | |
|---|---|---|---|
| 3-243358 | 10/1991 | Japan | B41J 2/045 |
| 4-353455 | 12/1992 | Japan | B41J 2/045 |
| 5-104725 | 4/1993 | Japan . | |
| 5-107932 | 4/1993 | Japan . | |
| 5-269984 | 10/1993 | Japan | B41J 2/045 |

*Primary Examiner*—Benjamin R. Fuller
*Assistant Examiner*—C. Dickens
*Attorney, Agent, or Firm*—Burns, Doane, Swecker & Mathis, LLP

[57] ABSTRACT

A piezoelectric member includes a flat part and a plurality of convex parts on the flat part, and at least a part of each convex part is a piezoelectric element. A non-piezoelectric member is made of non-piezoelectric materials, and includes a plurality of concave parts corresponding to the piezoelectric elements and a convex part formed between adjacent concave parts. The piezoelectric member and the non-piezoelectric member are engaged with each other by inserting each non-piezoelectric convex part between adjacent piezoelectric elements and an ink cavity is formed between a bottom surface of each concave part and a top surface of each piezoelectric element. Also between a side of the piezoelectric convex part and a side of the non-piezoelectric concave part is provided a space, and the space is filled with a filler.

40 Claims, 25 Drawing Sheets

PRIOR ART

Fig. 14(a)
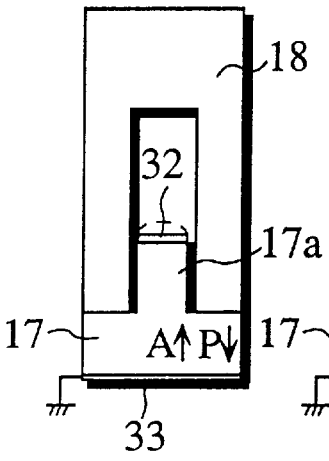
Fig. 14(b)
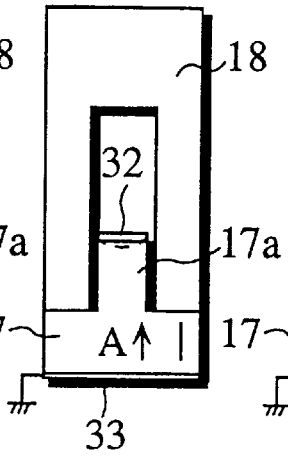
Fig. 14(c)
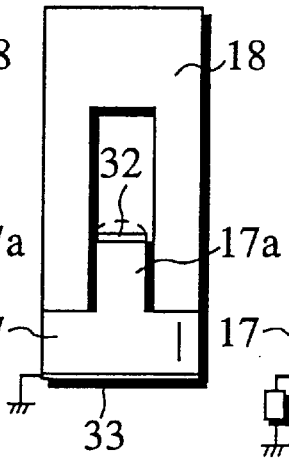
Fig. 14(d)
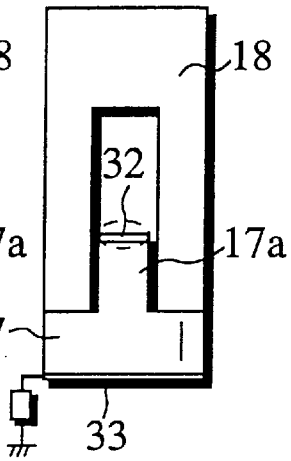
Fig. 14(a-1)
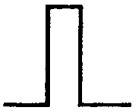
Fig. 14(a-3)
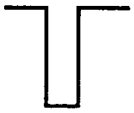
Fig. 14(a-5)
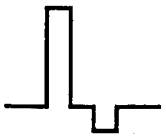
Fig. 14(a-7)
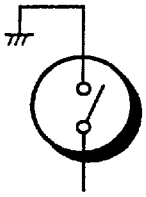
Fig. 14(a-2)
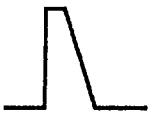
Fig. 14(a-4)
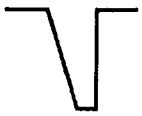
Fig. 14(a-6)
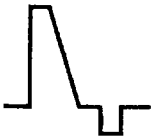
Fig. 14(e-1)
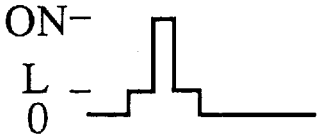
Fig. 14(f-1)
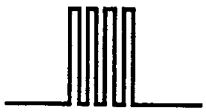
Fig. 14(g-1)
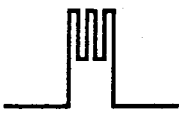
Fig. 14(e)
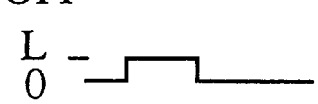
Fig. 14(f)
Fig. 14(g)

INK JET RECORDING HEAD INCLUDING INTERENGAGING PIEZOELECTRIC AND NON-PIEZOELECTRIC MEMBERS AND METHOD OF MANUFACTURING SAME

BACKGROUND OF THE INVENTION (1) Field of the Invention

The present invention relates to an ink jet recording head which jets ink in the form of a droplet from an ink nozzle by utilization of a piezoelectric effect.

(2) Description of the Related Art

An ink jet recording head for jetting ink in the form of a droplet from an ink nozzle by utilization of a piezoelectric effect has been well known in the art. Examples of such ink recording heads are disclosed in U.S. patent application Ser. Nos. 4,819,614 and 4,752,788.

FIG. 1 is a sectional view of a conventional ink jet recording head. As shown in FIG. 1, a plurality of concave-shaped ink cavities 52 are formed on one surface of a piezoelectric plate 51; the piezoelectric plate 51 made of piezoelectric materials is disposed between adjacent concave-shaped ink cavities; and a convex portion 53 made of piezoelectric materials is formed to conform the concave shape of the concave-shaped ink cavity 52. The top of the concave-shaped ink cavities is covered with a cover plate 54.

Each of the concave-shaped ink cavities 52 matching with the convex portion 53 comprises two deep grooves (b) for spacing the piezoelectric plate 51 and the convex portion 53 from each other and a shallow groove (a) between the deep grooves (b). An electrode 55 is provided on the bottom of the piezoelectric plate 51; and an electrode 56 is provided on the convex-portion 53. Also, a nozzle 57 is formed on the same surface of the piezo-electric plate 51 as the ink cavity to have the nozzle be coupled with the corresponding ink cavity.

When a voltage is applied across a selected pair of electrodes 55 and 56 in the ink jet recording head thus constructed, the convex portion 53 is deformed to change the volume of the ink cavity 51; as a result, ink in the ink cavity is jetted from the nozzle. The ink jet recording head, however, has the following drawbacks.

As was described with referring to FIG. 1, two deep grooves and one shallow groove are constructed in the piezo-electric plate 51; and the manufacturing cost of this piezo-electric plate 51 is relatively expensive. Particularly in the case when it is required to arrange ink cavities at a high density, the width of each groove (b) becomes as narrow as some $\mu$m, and it is considerably difficult for the present manufacturing technique to form such ink cavities in a piezo-electric plate.

Further, between adjacent ink cavities is provided a bulkhead made of piezoelectric materials, accordingly, an electric field formed across the electrodes 55 and 56 may vibrate the bulkhead between the ink cavities. As a result, the volume of the adjacent ink cavity is changed due to cross-talk between the ink cavities. As a result, around a nozzle is stained with leakage of ink from the adjacent ink cavity, whereby the ink jetting direction is fluctuated.

The cross-talk between ink cavities may be prevented; however, since the convex-portion 53 and the bulkhead are provided as an integral unit, deformation of the convex portion 53 may cause deformation of the bulkhead. Consequently, effective ink jetting is hindered; otherwise, a high-speed response ability is retarded.

Further, the vibration of the convex portion 53 moves ink into the groove (b), the groove (b) for spacing the convex portion 56 and the bulkhead 51; therefore, ink jetting effect is degraded; or ink penetrates the convex portion 53 from its side walls, as a result of which a bulk resistance is lowered. Accordingly, a drop of voltage or an electrolysis of ink occurs. Also, a cavitation of ink occurs at the groove (b) due to the vibration of the piezoelectric plate, as a result of which effective jetting by utilization of pressure is hindered.

SUMMARY OF THE INVENTION

Accordingly, it is an object of the present invention to provide an ink jet recording head which can be readily manufactured at a low manufacturing cost, and to achieve effective ink jetting by preventing cross-talk between ink cavities.

Also it is another object of the present invention to provide an ink jet recording head which enables effective jetting of ink which is pressured due to vibration of an piezoelectric member by preventing a drop of an effective voltage and a cavitation.

The above objects may be fulfilled by a multi-nozzle ink jet head comprising a first member including a plurality of first convex parts disposed in line on a part of its surface, in which at least a part of the first convex part is a piezoelectric element, a second member made of non-piezoelectric materials, including a plurality of concave parts which correspond to the first convex parts, and a second convex part disposed between every two adjacent concave parts, in which the second member is engaged with the first member by inserting each second convex part between a couple of adjacent first convex parts and forming an ink cavity between a bottom of each concave part and a top of the respective first convex part, and a plurality of electrodes being applied to the piezoelectric element included in the first convex part, in which each electrode deforms the respective piezoelectric element by applying a voltage to the same and jets ink in the ink cavity from an ink nozzle.

The first convex part may be inserted into the non-piezoelectric concave part in such a manner that either of them can be movable to the other.

A first gap may be formed between a side surface of the first convex part and a side surface of the non-piezoelectric concave part.

The second filling member for filling the second gap may include a filling and adhesive member, the surface of the first member including the convex part may be covered with a protection film and the protection film may be adhered to the convex part with the filling and adhesive member, and the second filling member may include a part of the protection film besides the filling and adhesive member.

The first member may include a base member and a piezoelectric chip which is disposed on the base member, the piezoelectric chip being equivalent to the piezoelectric element.

The electrodes may be disposed on surfaces of the corresponding piezoelectric chip, the surfaces opposing to each other.

Any one of the piezoelectric chips may be a lamination of piezoelectric layers.

The piezoelectric element may be made of piezoelectric materials and the first member is an integral unit.

Conductive treatment may be applied to the first member except the first convex part.

The piezoelectric element included in the first convex part may be polarized in the same direction as an electric field formed by applying a voltage across the electrodes, and the polarization direction may be substantially perpendicular to an ink jetting direction.

A front end of each ink cavity along with the ink jetting direction may be covered with a front member in which the ink nozzles are formed, a back end of each ink cavity along with the ink jetting direction may be blocked with a block member, and a ink supplying slit communicating with the ink cavity may be formed in the second member.

A non-return valve may be constructed to the ink supplying slit.

According to this construction and manufacturing method, the first member can be readily formed; accordingly the manufacturing cost is reduced by large.

Since the bulkhead between the adjacent ink cavities is made of non-piezoelectric materials, it is not vibrated by the electric field generated by application of a voltage across a selected pair of electrodes. Also, since the bulkhead and the first convex part in the first member are formed independently from each other, a cross-talk can be highly suppressed.

The second object may be fulfilled by the multi-nozzle ink jet head further including a first filling member for filling the first gap.

One surface of the first member which includes the convex part may be covered with a protection film, and the first filling member may consist of a part of the protection film.

A second gap may be formed between a top surface of the non-piezoelectric second convex and the first member, and the second gap may be filled with a second filling member.

In this construction, by filling the gap between the first convex part in the first member and the sides of the concave part in the second member, insertion of ink is prevented; accordingly, ink jetting efficiency is improved. Further, by doing so, ink can be prevented from penetrating the first convex part in the first member through its side walls, as a result of which a drop of effective voltage and an electrolysis of ink are prevented. Also, no cavitation occurs at the bulkhead, so that ink jet efficiency is improved Also the second object may be fulfilled by a multi-nozzle ink jet head comprising a plurality of ink cavities disposed in line, in which adjacent ink cavities are separated by a wall, a plurality of piezoelectric elements, each of which protrudes into each ink cavity and a space exists between itself and the wall, a plurality of electrodes which correspond to each piezoelectric element, and deforms the corresponding piezoelectric element by applying a voltage thereto so that ink in the ink cavity is jetted, and a filling member for filling the space between the piezoelectric element and the wall.

Also in this construction, the gap between the sides of the piezoelectric convex part and the bulkhead is filled with the filling member; accordingly, the above effects can be achieved.

The first object may be fulfilled by a method of producing a multi-nozzle ink jet head comprising the steps of producing a first member where a plurality of first convex parts are disposed in line, and at least a part of the first convex part is a piezoelectric element, producing a second member from piezoelectric materials, which includes a plurality of concave parts corresponding to the first convex parts, and a second convex part being disposed between adjacent concave parts, engaging the first member and the second member in such a manner that first convex part is inserted into the non-piezoelectric concave part, and an ink cavity is formed between a top of the first convex part and a bottom of the non-piezoelectric concave part.

The method may further comprise the step of forming a protection layer on one entire surface of the first member which includes the first convex part.

The method of may further comprise the step of totally covering one surface of the first member which includes the first convex part with a film.

The step of producing the first member may be the step of laying piezoelectric materials on a base member and cutting it into a predetermined shape so that the first member where the piezoelectric elements are disposed on the base member in line is produced.

BRIEF DESCRIPTION OF THE DRAWINGS

These and other objects, advantages and features of the invention will become apparent from the following description thereof taken in conjunction with the accompanying drawings which illustrate a specific embodiment of the invention. In the drawings:

FIGS. 14 (*a*) to (*d*), (*a*-1) to (*a*-7), (*e*-1), (*f*-1), (*g*-1), (*e*), (*f*), and (*g*) are diagrams for a description of the relationship between a pulse waveform of an applied voltage and a deformation of a piezo-electric plate;

DETAILED DESCRIPTION OF PREFERRED EMBODIMENTS

[Embodiment 1]

Figure 2:
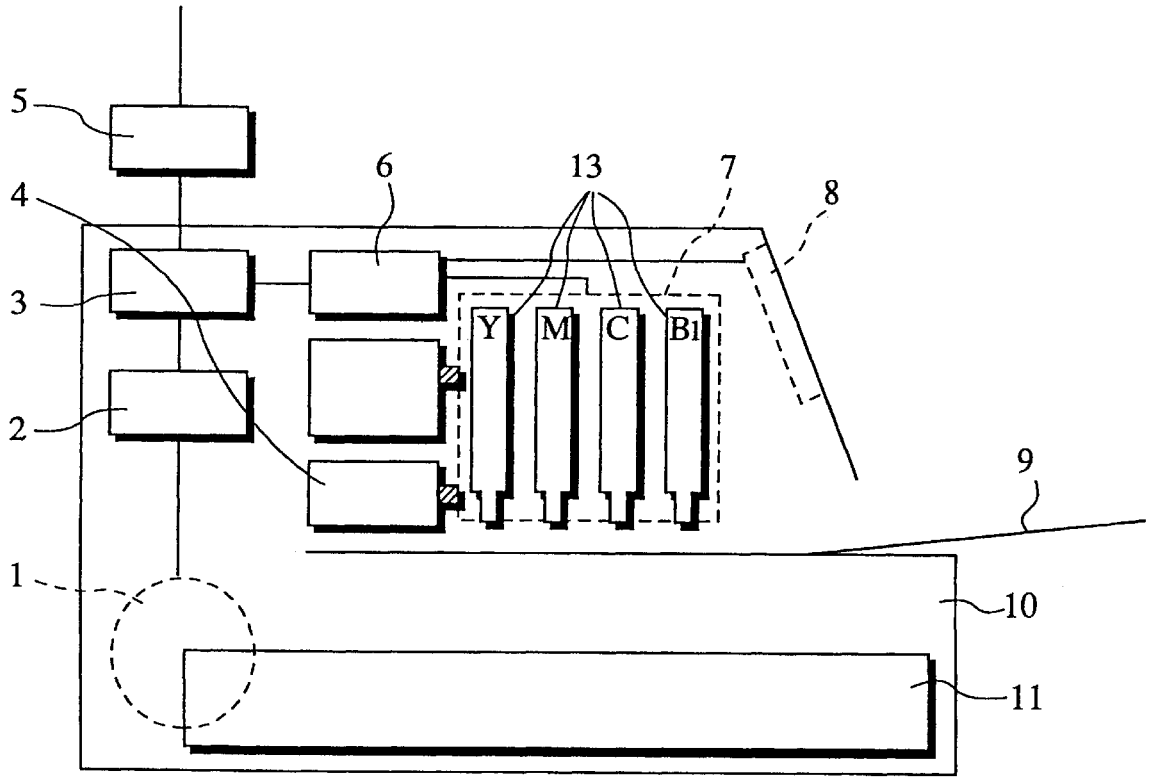
FIG. 2 shows the configuration of a multi-nozzle type ink jet recording head according to the present invention.

A piezoelectric plate and a piezoelectric chip are made of piezoelectric materials as an integral piezoelectric member in a first embodiment. FIG. 2 shows a multi-nozzle type ink jet recording head according to the embodiment. The ink jet recording head mainly comprises a paper supplying system 1, a main engine controller 2, a controller 3, a cleaning recovery system 4, an interface 5, a driver unit 6, a line head unit 7, an operation unit 8, a paper feeding tray 9, a body 10, and a recording paper cassette 11. The line head unit 7 is comprised of a multi-nozzle head 13 for four complementary colors of yellow, magenta, cyan, and black.

Figure 3:
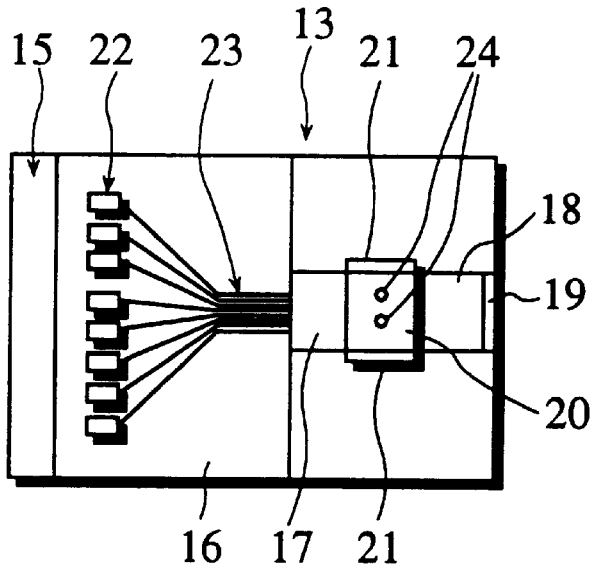
FIG. 3 is a plan view of an embodiment of the present invention.
Figure 4:
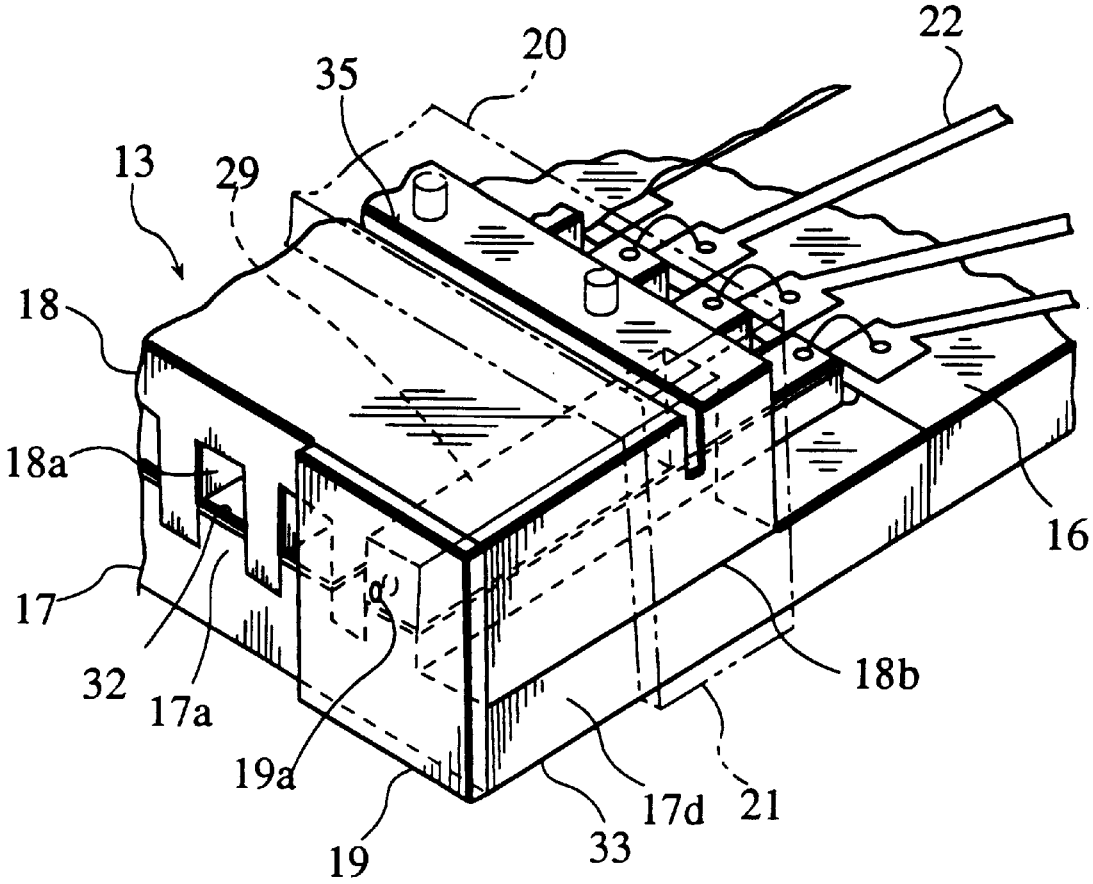
FIG. 4 is a perspective view of the embodiment of the present invention.

FIG. 3 is a plan view of the multi-nozzle head 13; and FIG. 4 is a partially cutaway view in perspective of the multi-nozzle head 13.

Figure 13:
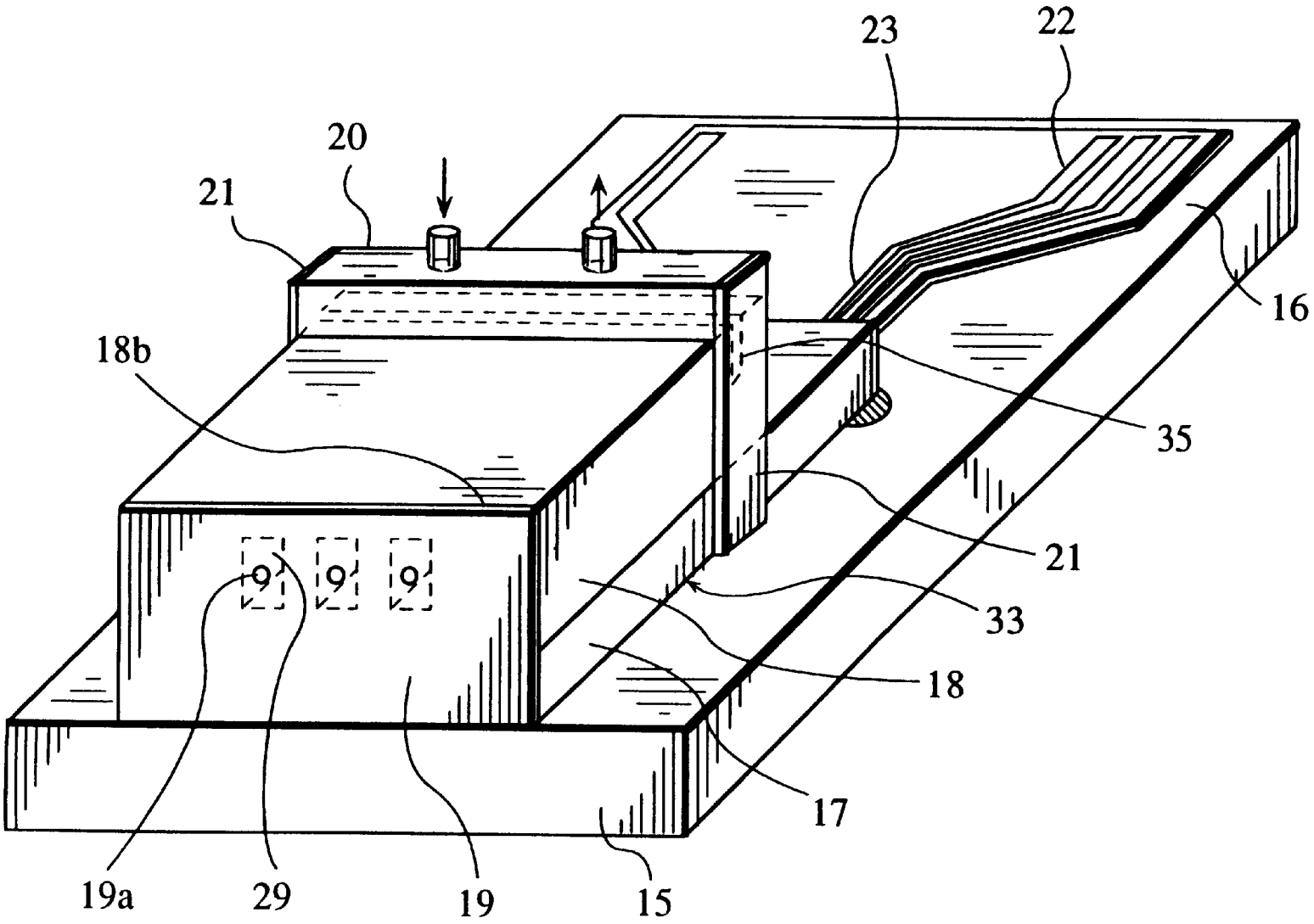
FIG. 13 shows a manufacturing step of the first embodiment.

As shown in FIGS. 3 and 4, the multi-nozzle head 13 comprises a base plate 15 made for instance of alumina; a terminal board 16 and a piezoelectric member 17 which are provided on the base plate 15; and a non-piezoelectric member 18 which is laid on the piezoelectric member 17 (FIG. 13). The piezoelectric member 17 is made for instance of PZT piezoelectric ceramics, or other materials which will be described later.

As shown in FIG. 4, on one surface of the piezoelectric member 17 which confronts with the non-piezoelectric member 18, a plurality of elongated grooves (convex portion 17*a*) are formed in the longitudinal direction at predetermined intervals along with the width of the member 18.

The non-piezoelectric member 18 is made of non-piezoelectric materials (exemplary materials will be described later), and a plurality of concave portions 18*a* are formed in the non-piezo electric member 18 to conform to the convex portions 17*a* in the piezoelectric member 17. For example, the length of the non piezoelectric member 18 is 2–50 mm; the width of each convex portion 17*a* is 20–150 $\mu$m; and the convex portions 17*a* are placed at intervals of 42,3–254 $\mu$m (pixel density: 60–100 dpi).

Figure 5:
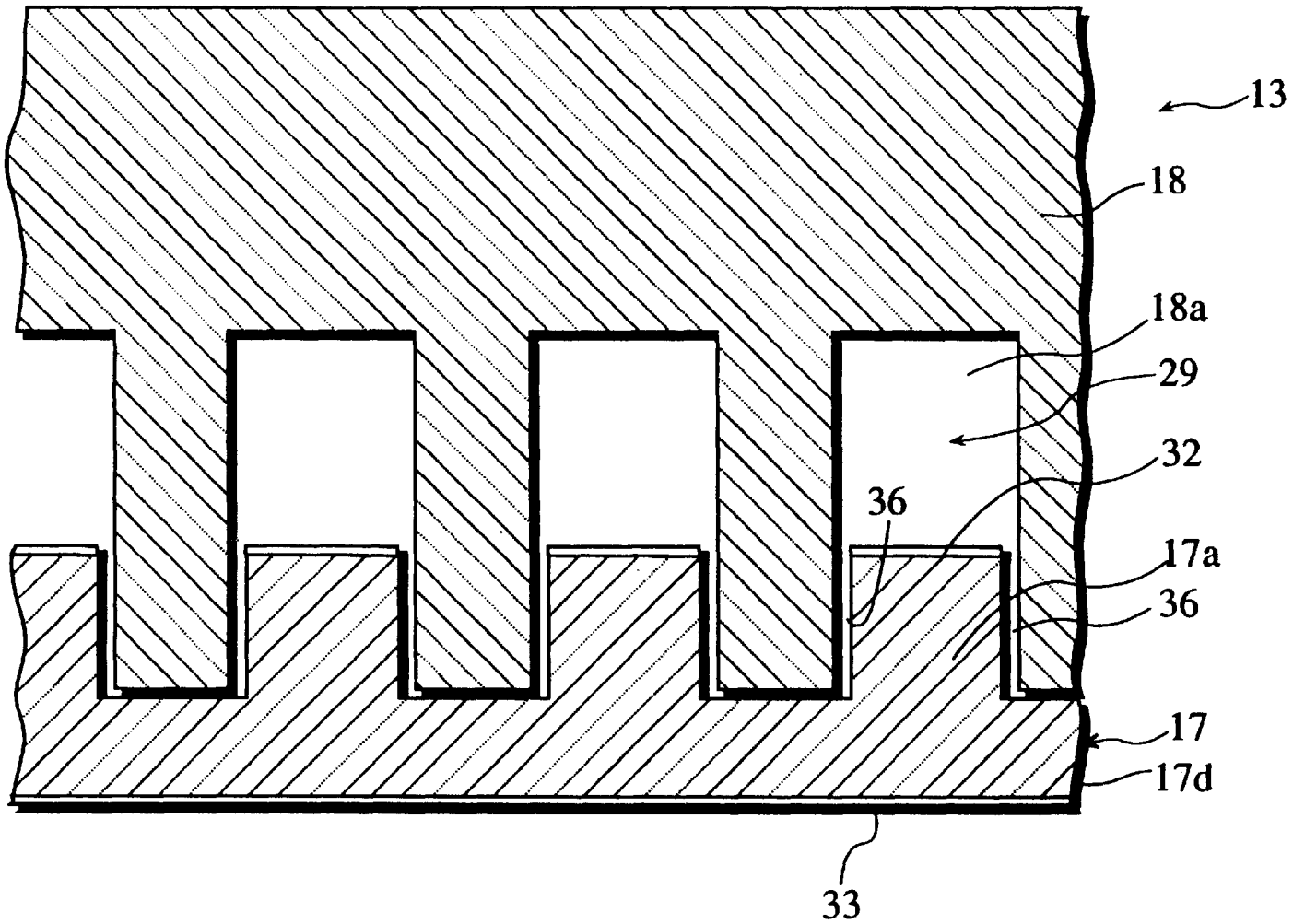
FIG. 5 is a cross-sectional view of a first embodiment.

FIG. 5 is a cross-sectional view of the multi-nozzle head 13. As shown in FIG. 5, when the convex portion 17*a* and the concave portion 18*a* are engaged with each other, a space is formed between their sides. Both sides of the piezoelectric member 17 and the non-piezoelectric member 18 are fixedly secured to each other with adhesive or the like, and hence ink cavities 29 are formed between the convex portions 17*a* and concave portions 18*a*.

An individual electrode 32 is provided on top of the convex portion 17*a* which is formed in the piezoelectric member 17; and an electrode 33 is provided on bottom of the piezo-electric electric member 17 in such a manner that it is confronted with the respective individual electrode 32 across the piezoelectric member 17.

Although not illustrated in FIG. 5, the whole surface of the convex portion 17*a* in the piezo-electric member 17 is covered with an insulating protection film (overcoat film) 17*c* (this coverage with the insulating protection film 17*c* can be omitted if a high ink resistance is applied).

Figure 6:
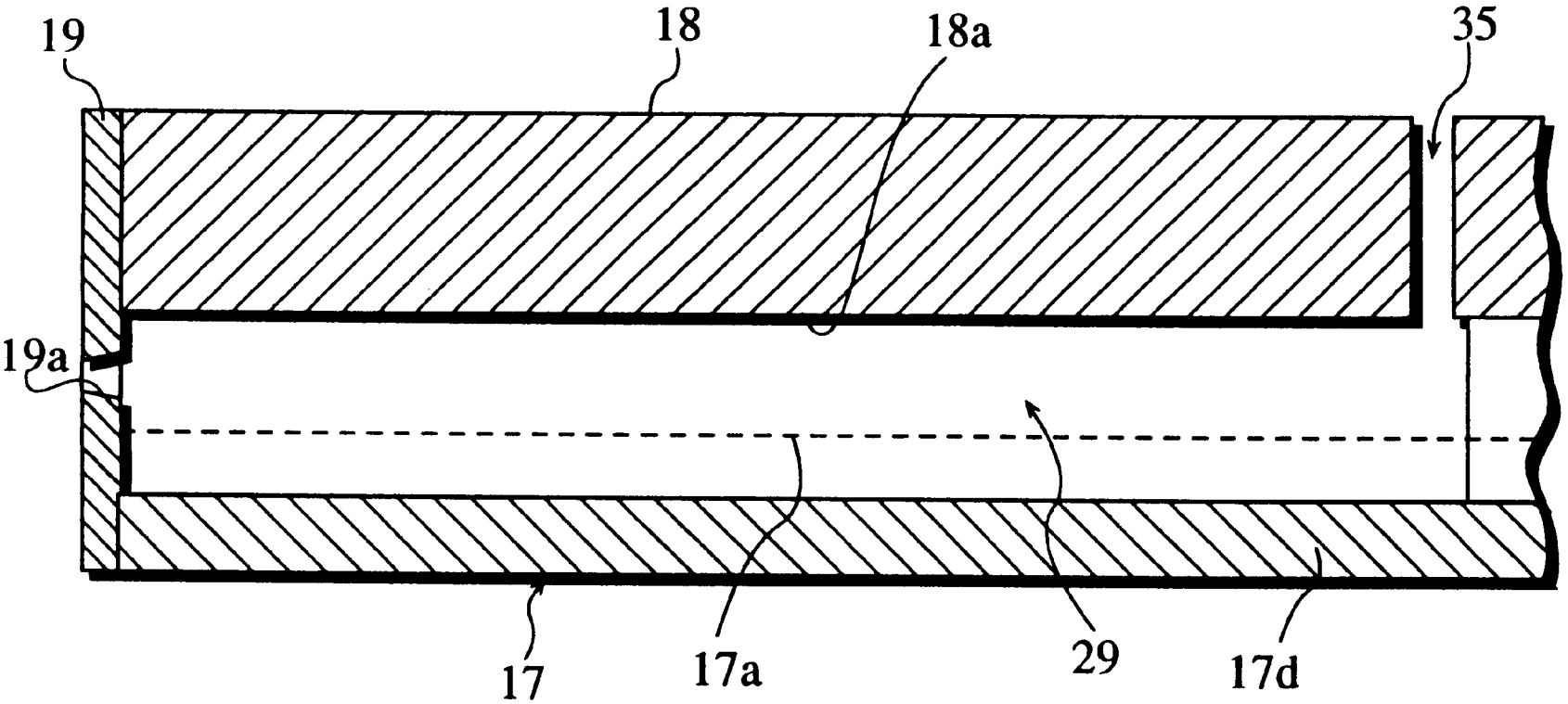
FIG. 6 is a longitudinal-sectional view of the first embodiment.

FIG. 6 is a longitudinal-sectional view of the multi-nozzle head 13. A nozzle plate 19 which is made for instance of a polyamide film is provided to the piezoelectric member 17 and the non-piezoelectric member 18 as shown in FIG. 6, and a convergent ink nozzle 19*a* is formed in the nozzle plate 19 in such a manner that it is communicated with the ink cavity 29. The nozzle plate 19 is fixedly secured to the piezoelectric member 17 and the non-piezoelectric member 18 with epoxy adhesive or the like; and the ink nozzle l9*a* is formed in the nozzle plate 19 by excimer laser. For example, the nozzle plate 19 is made of a polyamide film (KAPUTON by Toray Industries, Inc.) which is 25–200 $\mu$m in thickness; and the diameter of the ink nozzle 19*a* is 10–100 $\mu$m.

As shown in FIGS. 3 and 4, an ink supplying inlet 35 is formed in the non-piezoelectric member 18 in such a manner that it is communicated with every ink cavity 29. Upper surface of the non-piezoelectric member 18 is covered with an ink cover 20 made of epoxy resin while sides of the piezo-electric member 17 are covered with a block plate 21 made of epoxy resin, and hence the ink supplying inlet 35 is fully covered. Further, slits 24 are formed on the ink cover 20 for supplying ink to the ink supplying inlet 35.

A number of terminals 22 and conductors 23 connected to the respective terminals 22 are provided on the terminal board 16 as an integral unit by metalization. The individual electrode 32 and the electrode 33 are connected to an output terminal of the driver unit 6 (FIG. 2) via the conductors 23 and the terminals 22 on the terminal board 16 which are constructed as shown in FIGS. 3 and 4.

The piezoelectric material 17 is in parallel with an electric field which is generated when a voltage is applied to a selected pair of electrodes 32 and 33; and an ink jetting direction is perpendicular to the electric field.

The piezoelectric member 17 may be made of the following piezoelectric materials.

(1) Piezoelectric crystal:

Quarts ($SiO_2$)

Rochelle salt (RS: $NaKC_4H_4O_6.4H_2O$)

Ethylene diamin tartrate (EDT: $C_6H_{14}N_2O_6$)

Dipotassium tartrate (DKT: $K_2C_4H_4O_6.½ H_2O$)

Ammonium dihydrogen phosphate (ADP: $NH_4H_2PO_4$)

Perovskite family crystal (e.g.) $CaTiO_3$ $BaTiO_3$

PLZT

Tungsten-bronze crystal
(e.g.) $NaxWO_3$ ($0.1<x<0.28$),
Barium sodium niobate ($Ba_2NaNb_5O_{15}$)
Potassium lead niobate ($Pb_2KNb_5O_{15}$)
Lithium niobate ($LiNbO_3$)
Lithium tantarete ($LiTaO_3$)
Soda chlorate ($NaClO_3$)
Tourmaline
Zinc sulfide (ZnS)
Lithium sulfate ($LiSO_4H_2O$)
Lithium metagallium ($LiGaO_2$)
Lithium iodate ($LiIO_3$)
Glysine sulfate (TGS)
Bismuth germanium ($Bi_{12}GeO_{20}$)
Lithium germanium ($LiGeO_3$)
Barium germanium Titanium ($Ba_2Ge_2TiO_8$)

(2) Piezoelectric semi conductor:

Wurtzite

BeO

ZnO

CdS

CdSe

AIN (3) Piezoelectric ceramics:

Barium titanium ($BaTiO_3$)

Lead zirconium titanium ($PbTiO_3.PbZrO_3$)

Lead titanium ($PbTiO_3$)

Barium lead niobate ($(Ba\text{-}Pb)Nb_2O_6$)

(4) The piezoelectric member 17 may be made by dispersing powders of the above piezoelectric crystal (1), piezoelectric semi-conductor (2), and piezoelectric ceramics (3) upon plastics, then shaping the dispersing results.

(5) Piezoelectric high polymers:

Poly(vinyl fluoride)PVDF ($—CH_2—CF_2—$)n

Poly(vinyl fluoride)/PZT

Rubber/PZT a copolymer of trifluoro ethylene and vinyl fluoride a copolymer of vinylidene cyanide and vinyl acetate Poly(vinylidende cyanide)

The piezoelectric member 17 is generated by polarizing the above materials, then processing the polarizing results; otherwise, the above materials are processed first, then the processing results are polarized.

The non-piezoelectric member 18 may be made of the following non-piezoelectric materials.

(6) ceramics:

$Al_2O_3$, SiC, C, $BaTiO_3$, $BiO_3$, $3SnO_2$, $Pb(Zrx, Ti_{1-x})O_3$, ZnO, $SiO_2$, $(1\text{-}x)Pb(Zr_x, Ti_{1-x})O_3+(x)La_2O_3$, $Zn_{1-x}Mn_xFe_2O_3$, $\gamma\text{-}Fe_2O_3$, $SrO.6Fe_2O_3$, $La_{1-x}Ca_xCrO_3$, $SnO_2$, transition metal oxide, $ZnO\text{-}Bi_2O_3$, semi-conductive $BaTiO_3$, $\beta\text{-}Al_2O_3$, stabilized zirconia, $LaB_6$, $B_4C$, diamond, TiN, TiC, $Si_3N_4$, $Y_2O_2S$: Eu, PLZT, $ThO_2$, —$CaO.nSiO_2$, $Ca_5(F,Cl)P_3O_{12}$, $TiO_2$, $K_2O.nAl_2O_3$, (7) glass:

element glass=Si, Se, Te, As, hydrogen bonding glass=$HPO_3$, $H_3PO_4$, $SiO_2$, $B_2O_2$, $P_2O_5$, $GeO_2$, $As_2O_3$ glass oxide=$SbO_3$, $Bi_2O_3$, $P_2O_3$, $V_2O_5$, $Sb_2O_5$, $As_2O_3$, $SO_3$, $Zro_2$ glass fluoride=$BeF_2$ glass chloride=$ZnCl_2$ glass sulfide=$GeS_2$, $As_2S_3$ glass carbonate=$K_2CO_3$, $MgCO_3$ glass nitrate=$NaNO_3$, $KNO_3$, $AgNO_3$ glass sulfate=$Na_2S_2O_3.H_2O$, $Tl_2SO_4$, alumite glass silicate=$SiO_2$ glass alkali silicate=$Na_2O\text{-}CaO\text{-}SiO_2$ glass potassium lime=$K_2O\text{-}CaO\text{-}SiO_2$ glass soda-lime=$Na_2O\text{-}CaO\text{-}SiO_2$ glass lead glass barium glass borosilicate (8) plastics:

thermoplastic resin such as saturated polyester resin, polyamide resin, aramido resin, acrylic resin, ethylene-vinyl acetate resin, ion bridging olefin polymerization (ionomer), styrene-butadiene block polymerization, polyacetal, polycarbonate, vinyl chloride-vinyl acetate polymerization, cellulose ester, polyimide, or styrol thermosetting resin such as epoxy resin, urethane resin, nylon, silicone resin, phenolic resin, melamine resin, xylene-formaldehyde resin, alkyd resin, thermosetting acrylic resin;

photoconductive resin such as poly(vinylcarbazole), poly (vinylpyrene), poly(vinylanthracene), or poly(vinyl alcohol).

These materials for plastics may be utilized by itself, or in combination.

Also, a mixture of engineering plastics such as liquid crystal polymer, plastics, and powder whisker may be utilized.

Photosensitive resin, thick-film use photoresist resin, or the like may be utilized. It may be bakelite, fluororesin, or glass-epoxy resin (glass filler is mixed in epoxy).

(9) Other materials

Any metal can be used to cover a side of the non-piezoelectric member which is in contact with respective ink cavity.

In producing the non-piezoelectric member, a non-piezoelectric plate is produced from these materials, then the non-piezoelectric member is produced from the non-piezoelectric plate; otherwise, the non-piezoelectric member 18 is directly produced from these materials by pattern etching, photosetting, or the like.

[Production of Multi-Nozzle Head]

The production of the multi-nozzle head thus constructed is described below as referring to FIGS. 7–13.

Figure 7:
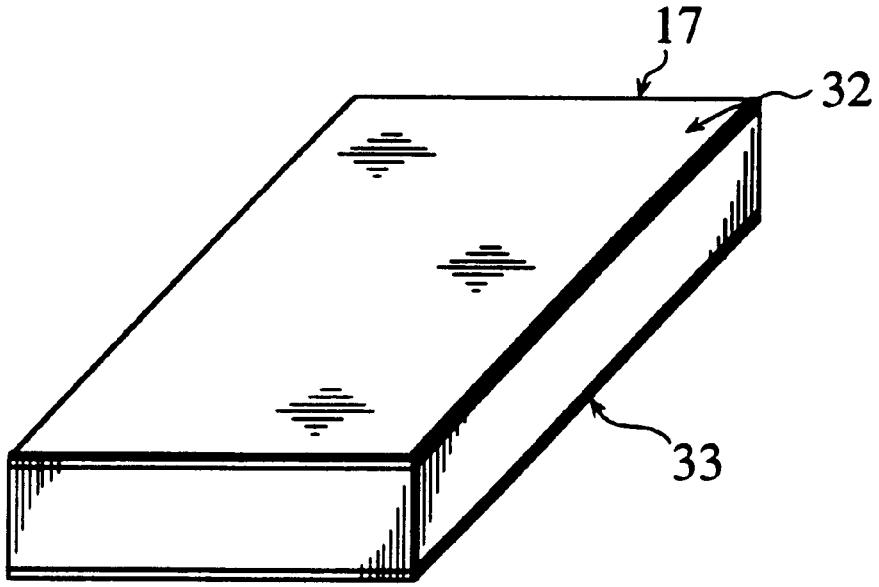
FIG. 7 shows a manufacturing step of the first embodiment.

As shown in FIG. 7, a sputter film of 10 $\mu$m–0.1 $\mu$m in thickness, such as an Au/Ni or Au/(Ni, Cr) film is provided on both top and bottom surfaces of an PZT piezoelectric plate which constitutes the piezoelectric member 17 by electroless plating, and hence electrode layers 32, 33 are formed.

Figure 8:
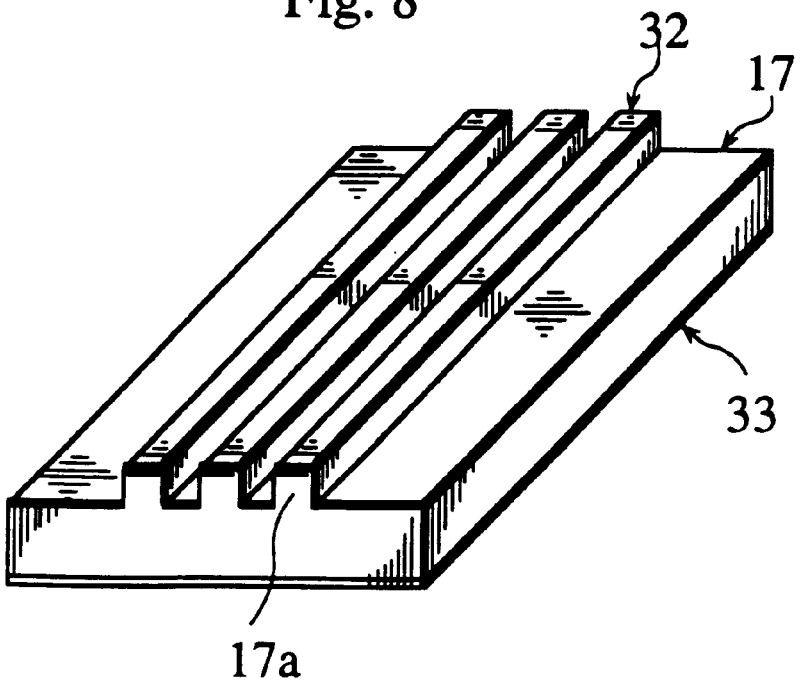
FIG. 8 shows a manufacturing step of the first embodiment.

As shown in FIG. 8, a plurality of convex portions 17*a* are formed at a predetermined interval in the piezoelectric member 17 with an automatic dicing saw.

Figure 9:
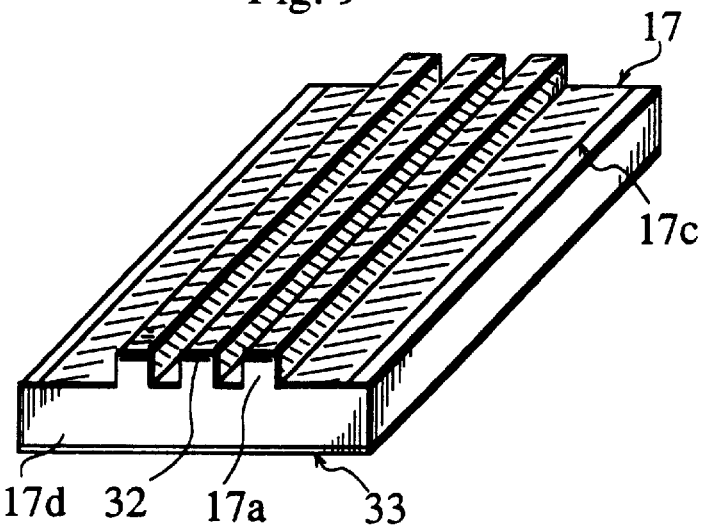
FIG. 9 shows a manufacturing step of the first embodiment.

As shown in FIG. 9, the whole surface of the convex portion 17*a* is covered with the insulating protection film 17*c* made of amotphosour carbon. The thickness of the insulating protection film 17*c* is 0.5 $\mu$m.

Figure 10:
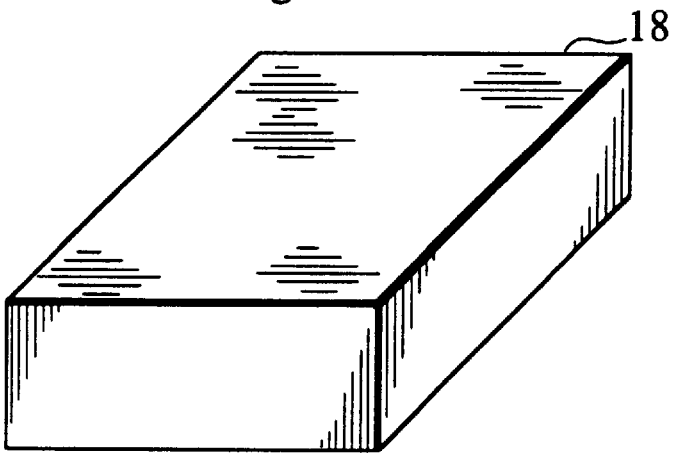
FIG. 10 shows a manufacturing step of the first embodiment.
Figure 11:
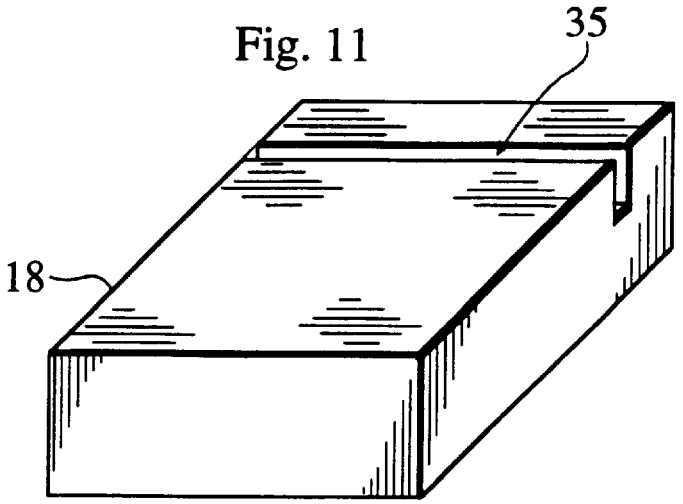
FIG. 11 shows a manufacturing step of the first embodiment.

The non-piezoelectric member 18 is made for instance of a rectangle alumina plate shown in FIG. 10. An ink-supplying inlet is formed in the non-piezoelectric member 18 with a dicing saw as shown in FIG. 11.

Figure 12:
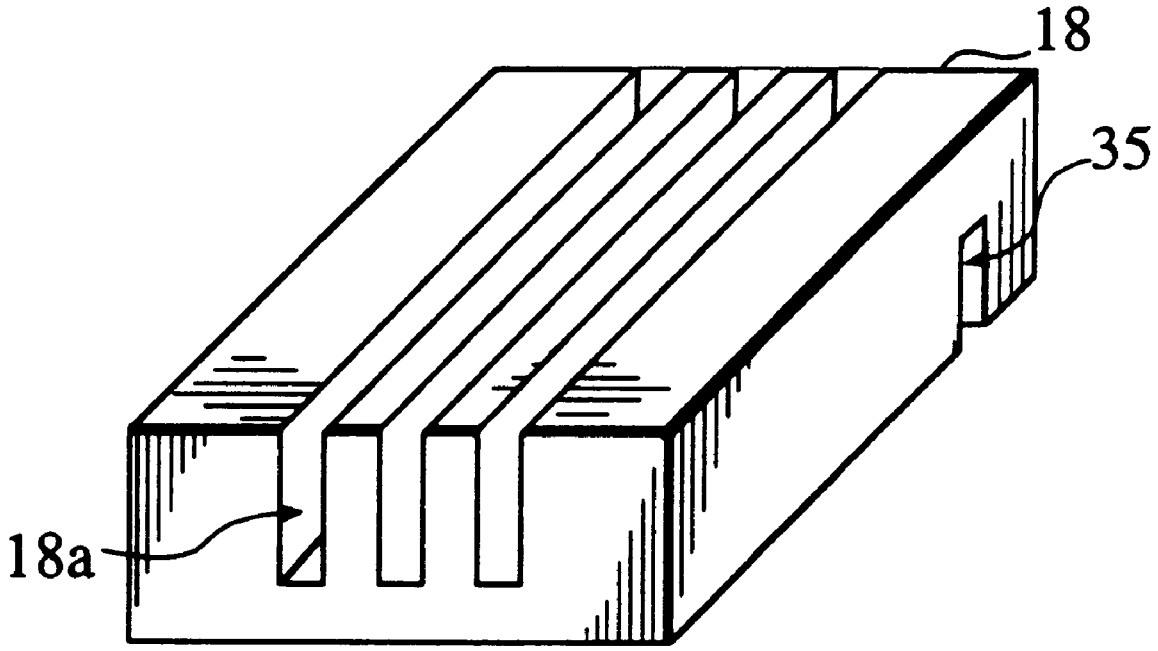
FIG. 12 shows a manufacturing step of the first embodiment.

As shown in FIG. 12, the concave portions 18*a* to be employed as the ink cavities 29 are formed in the non-piezoelectric member 18 by cutting elongated grooves with a dicing saw in such a manner that they are formed on the opposite surface of the member 18 to the ink-supplying inlets as well as they extend perpendicular to the ink-supplying inlets. (The dimension of the concave portion 18*a* is determined to engage itself with respective convex portion 17*a*.)

As shown in FIG. 13, the piezoelectric member 17 is disposed on a base plate 15; accordingly the piezoelectric member 17 and the non-piezoelectric member 18 are engaged with each other.

The piezoelectric member 17 and the non-piezoelectric member 18 are adhered to each other with epoxy-type adhesive 18*b*; the nozzle plate 19 including the ink nozzle 19*a* which is communicated with respective ink cavity 29 is constructed to the front face of the member 17 and 18; the ink cover 20 is fixed over the ink-supplying inlet 35; then the block plate 21 is provided to both sides of the members 17 and 18 with adhesive.

[Operation of Multi-Nozzle Head]

The operation of the multi-nozzle head 13 is described hereinafter.

FIGS. 14 (*a*) to (*d*) show embodiments of the relations between a pulse waveform of an applied voltage and deformation of the piezoelectric member 17. According to an image signal, the driver unit 6 applies a voltage across a selected pair of the individual electrode 32 and electrode 33; accordingly, an electric field is formed in A direction between the electrodes 32 and 33 as shown in FIG. 14 (*a*). Since the piezoelectric member 17 has been polarized in P direction, the convex portion 17*a* in the piezoelectric member 17 is expanded as shown by the dotted line in FIG. 14 (*a*) upon its vibration. As a result, the volume of the ink cavity 29 between the convex portion 17 and the concave portion 18*a* is decreased, and ink therein is jetted in the form of a droplet from the respective ink nozzle 19*a* to a recording paper (not shown).

When the application of the voltage across the electrodes 32 and 33 is suspended, the configuration of the convex portion in the piezoelectric member 17 is restored as shown by the solid line in FIG. 14 (*a*), and the volume of the ink cavity 29 is increased, as a result of which the ink is returned through the ink supplying inlet 35 to the ink cavity 29 to fill up the ink cavity so that the next ink jetting is ready.

According to an image signal, the above operations are conducted successively or concurrently. Thus, a line of image is drawn on a recording paper, and the drawing is synchronized with displacement of the recording paper. Consequently, an image corresponding to the image signals is completed on the recording paper.

The convex portion 17*a* expands upon its vibration and returns to its original shape upon suspension of an applied voltage. Since the non-piezoelectric member 18 and the convex portion 17*a* are not provided as an integral unit, vibration of the convex portion 17*a* is hardly transmitted to the non-piezoelectric member 18. Further, side walls of the ink cavity 29 are made of the non-piezoelectric member 18, which therefore an electric field generated across the electrodes does not enter therein. As a result, no vibration occurs at the side walls of the ink cavity 29.

By applying various waveforms of pulse signals shown by FIGS. 14 (*a*-1)–(*a*-7) in to the individual electrode 32, the following effects can be obtained.

When FIG. 14 (*a*-1) is applied, the volume of the ink cavity 29 is decreased rapidly, and ink is jetted from the ink cavity. However, in this case, the volume of the ink cavity 29 may be increased so fast to return to the original shape that bubbles may enter from the ink nozzle, and ink pressure for the next ink jetting is absorbed by these bubbles. Consequently, effective ink jetting is hindered.

When FIG. 14 (*a*-2) is applied, the volume of the ink cavity 29 is increased gradually to prevent the entering of bubbles. More specifically, the rapid change in the volume of the convex portion 17*a* after ink jetting is prevented by decreasing the pulse gradually, instead of decreasing it rapidly as shown by FIG. (*a*-1).

Pulses of FIGS. 14 (*a*-3) and (*a*-4) implement an ink jetting contrary to pulses of FIGS. 14 (*a*-1) and (*a*-2). When pulses of FIG. 14 (*a*-3) and (*a*-4) are applied, the ink cavity 29 is filled with ink first, then the volume of the ink cavity 29 is decreased to FIG. 14 jet the ink. Being Similar to (a-2), a gradual increase of pulse is achieved by FIG. 14 (*a*-4).

Pulses of FIGS. 14 (*a*-5) and (*a*-6) include a sub-pulse after a main pulse. When a high-speed printing is operated by utilization of high frequencies, satellite noise often occurs during ink jetting. To prevent any satellite noise, a sub-pulse in FIG. 14 (*a*-5) and (*a*-6) is applied to increase the volume of the respective ink cavity 29 by the degree to absorb a tail of an ink pole forcibly.

All of the pulses of FIGS. 14 (*a*-1)–(*a*-6), which have been described, and the pulses of FIGS. 14 (*e*-1)–(*g*-1), which will be described later, are implemented by applying a voltage to the electrode 32 according to image information. In contrast, the pulse of FIG. 14 (*a*-7) is implemented by applying a certain DV voltage to the electrode 33 but grounding the individual electrode 32 depending on image information, accordingly an electric field is generated between the electrodes 32 and 33. Image control by the utilization of the pulse of FIG. 14 (*a*-7) is accomplished by a switching circuit simply constructed, therefore, the manufacturing cost of a driver IC is reduced as well as it is easily operated.

The pulse of FIG. 14 (*e*-1) is implemented by raising a bias voltage to the individual electrode 32 by a predetermined level constantly. As a result, ink jetting can be operated with a small voltage, and running cost can be reduced remarkably.

Further, in the pulses of FIG. 14 (*f*-1) and (*g*-1), an AC-type component is added to a pulse waveform for single image information; therefore, the ink jetting can be cut sharply, and this overcomes the drawbacks in the conventional ink jet recording device. That is, especially when a number of pages are printed by the conventional pulse, a blunt ink cutting occurs and the recording papers are stained with dispersed ink, and the ink jetting direction is distorted. However, such image noise can be prevented by the utilization of the pulses of FIGS. 14 (*f*-1) and (*g*-1).

Figure 15:
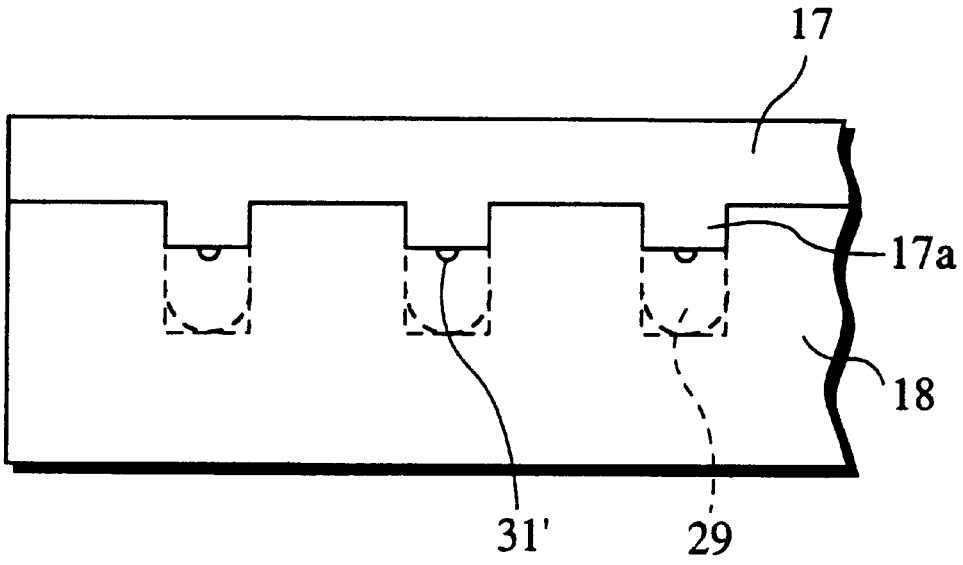
FIG. 15 is a cross-sectional view of a modification of the first embodiment.
Figure 16:
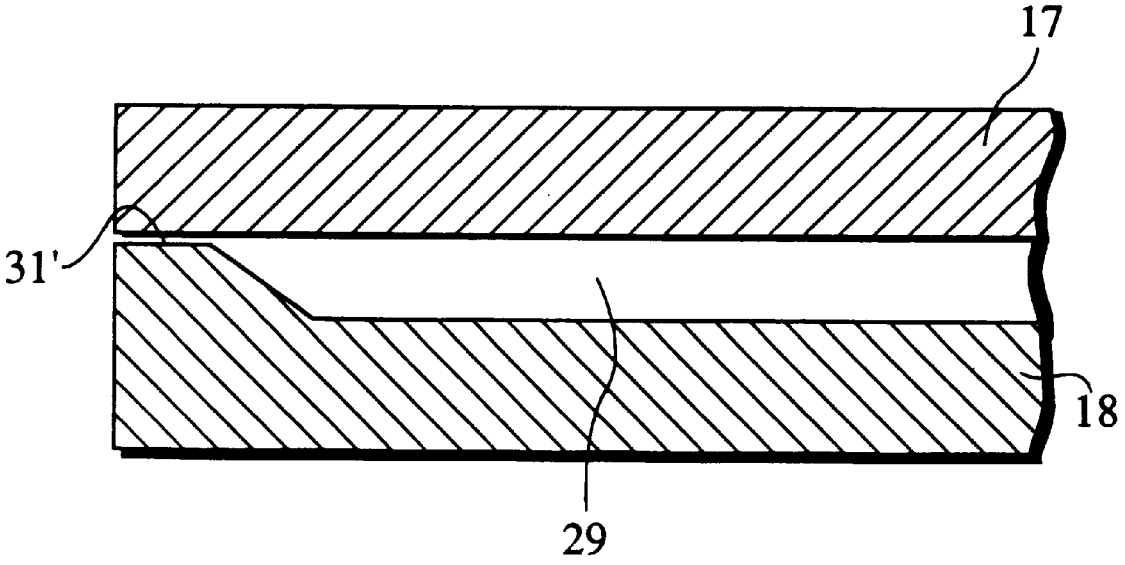
FIG. 16 is a longitudinal-sectional view of the modification of the first embodiment.

As a modification of the first embodiment, the piezoelectric member 17 and the non-piezoelectric member 18 may be engaged with each other without a space as shown by FIGS. 15 and 16; and a small groove 31' may be formed in the non-piezoelectric member 18 as an ink nozzle (or, the ink nozzle groove 31' is formed in the concave portion 17*a*). The configurations in FIGS. 15 and 16 exclude a nozzle plate, and reduce the manufacturing cost thereby.

Figure 17:
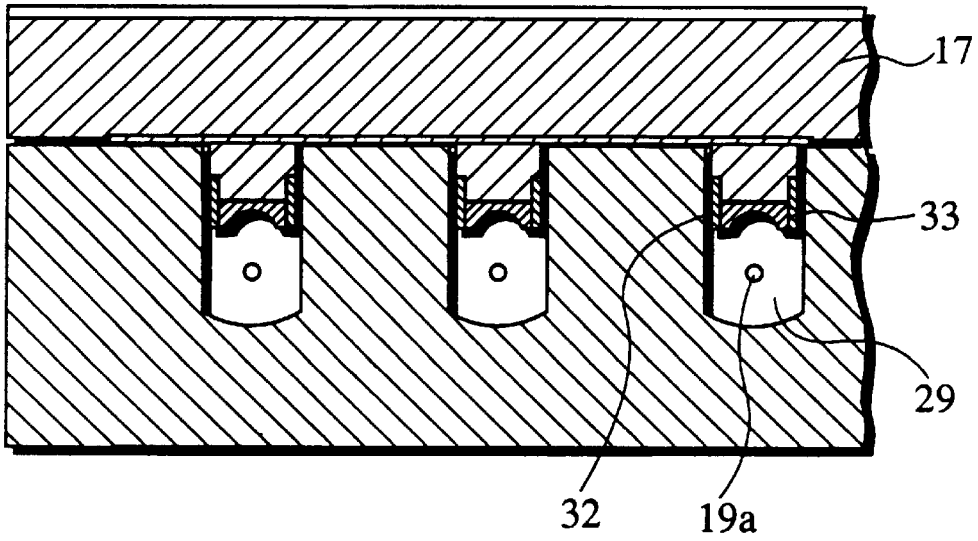
FIG. 17 is a cross-sectional view of the modification of the first embodiment.

The top of the convex portion 17*a* and the bottom of the inner surface of the concave portion 18*a* may be cut as a hollow as shown by FIG. 17. This configuration suppresses the entering of bubbles, so that ink jetting is improved. As a result, an applied voltage can be decreased.

Only sides of the piezoelectric member 17 and the non-piezoelectric member 18 may be fixedly secured to each other with the adhesive 18*b* (FIG. 4). Such partial adhesion does not decrease the pressure in the ink cavity 29 since the space between the piezoelectric member 17 and the non-piezoelectric member is made sufficiently small herein. Furthermore, by leaving some parts of the member 17 or 18 not adhered to the other, the distortion of the piezoelectric member 17 which occurs outside the convex portion 17*a* due to the vibration can be compensated by an absorption slipping. Therefore, effective ink jetting can be achieved at a high-speed as excluding any cross-talk between ink cavities.

[Embodiment 2]

A second embodiment is a modification of the first embodiment in which a concave portion in a non piezoelectric member is shaped as a trapezoid.

Figure 18:
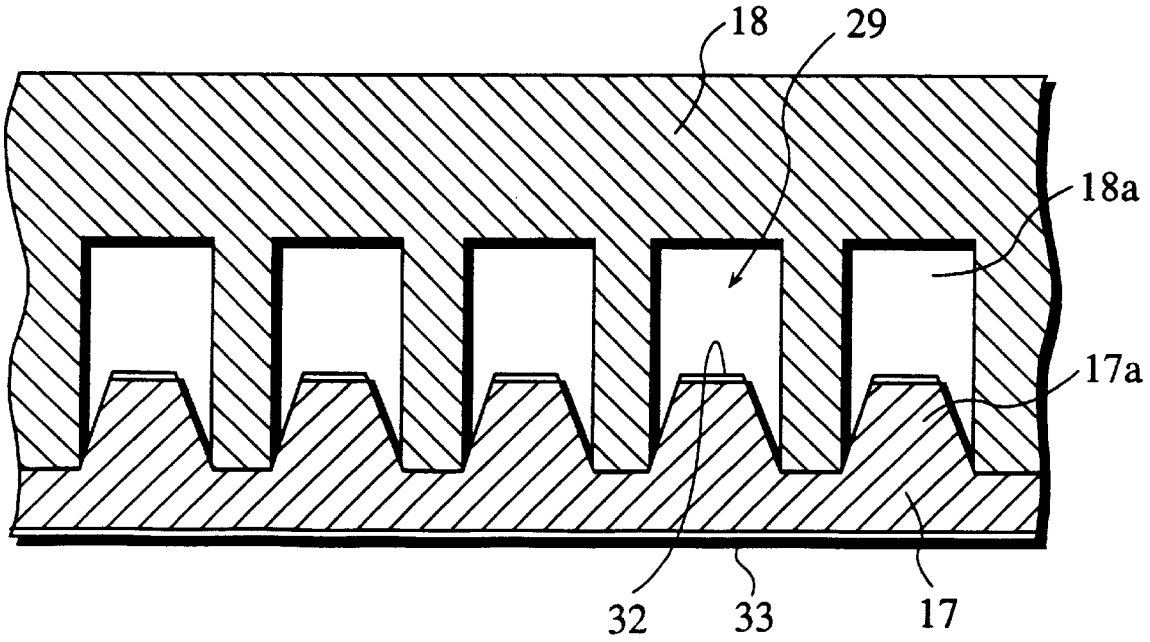
FIG. 18 is a cross-sectional view of a second embodiment.

FIG. 18 is a cross-sectional view of a multi-nozzle head according to the second embodiment. A convex portion 17*a* formed in a piezoelectric member 17 is shaped as a trapezoid as shown in FIG. 18, and the multi-head nozzle is formed by engaging the trapezoid-shaped convex portion 17*a* with a non-piezoelectric member shared with the first embodiment. Owing to its shape, the trapezoid-shaped convex portion 17*a* can be engaged with the non-piezoelectric member more easily, which therefore fabrication process can be simplified.

[Embodiment 3]

A third embodiment is a modification of the first embodiment, in which corners of an inner surface of a non-piezoelectric portion (including concave and codex shapes one after the other) are curved.

Figure 19:
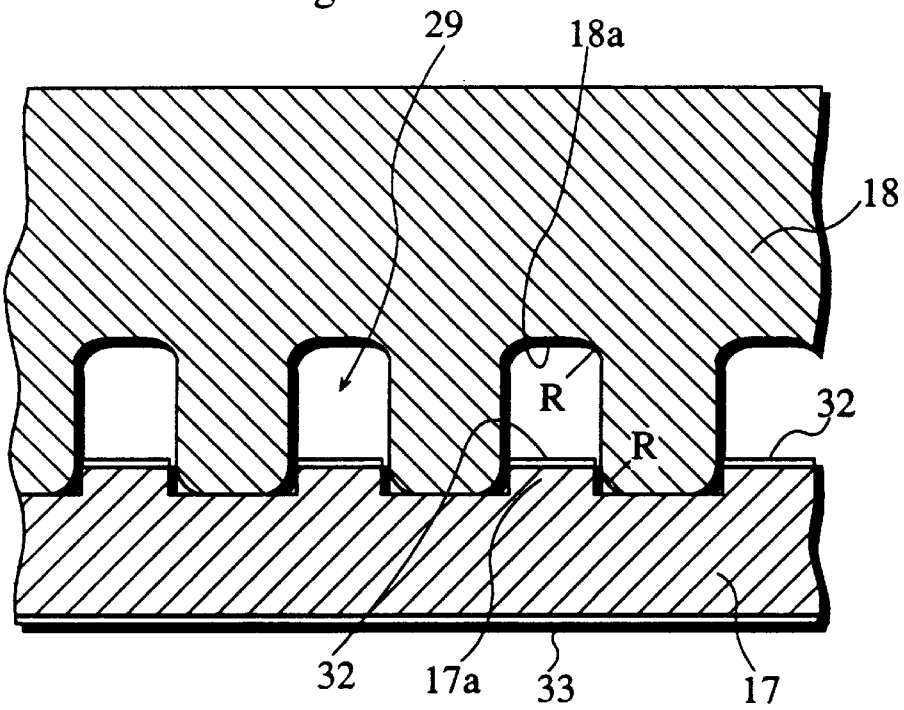
FIG. 19 is a cross-sectional view of a third embodiment.

FIG. 19 is a cross-sectional view of a multi-nozzle head according to the third embodiment. As shown in FIG. 19, a curvature R is formed on corners of inner surface of a non-piezoelectric member where concave and convex parts appear one after the other. Also, an electrode 32 is provided on a piezoelectric member 17 by printing or sintering.

In producing the piezoelectric member 17, PZT powders are baked and molded first; then the electrode 32 is formed thereon by print pasting silver palladium or palladium thereto.

By forming the curvature R, the area of the non-piezoelectric member 18 which is in contact with the piezo electric member 17 is decreased; therefore, even in the case of eccentric engagement between the members 17 and 18, effective ink jetting can be achieved. Moreover, the curvature R suppresses the generation of bubbles in an ink cavity 29.

The non-piezoelectric member 18 may be made of resin (industrial plastics) by injection molding, and the curvature R can be formed easily.

[Embodiment 4]

A fourth embodiment is a modification of the first embodiment, in which a concave portion is formed both on top and bottom of a non-piezoelectric member 18 staggeringly.

Figure 20:
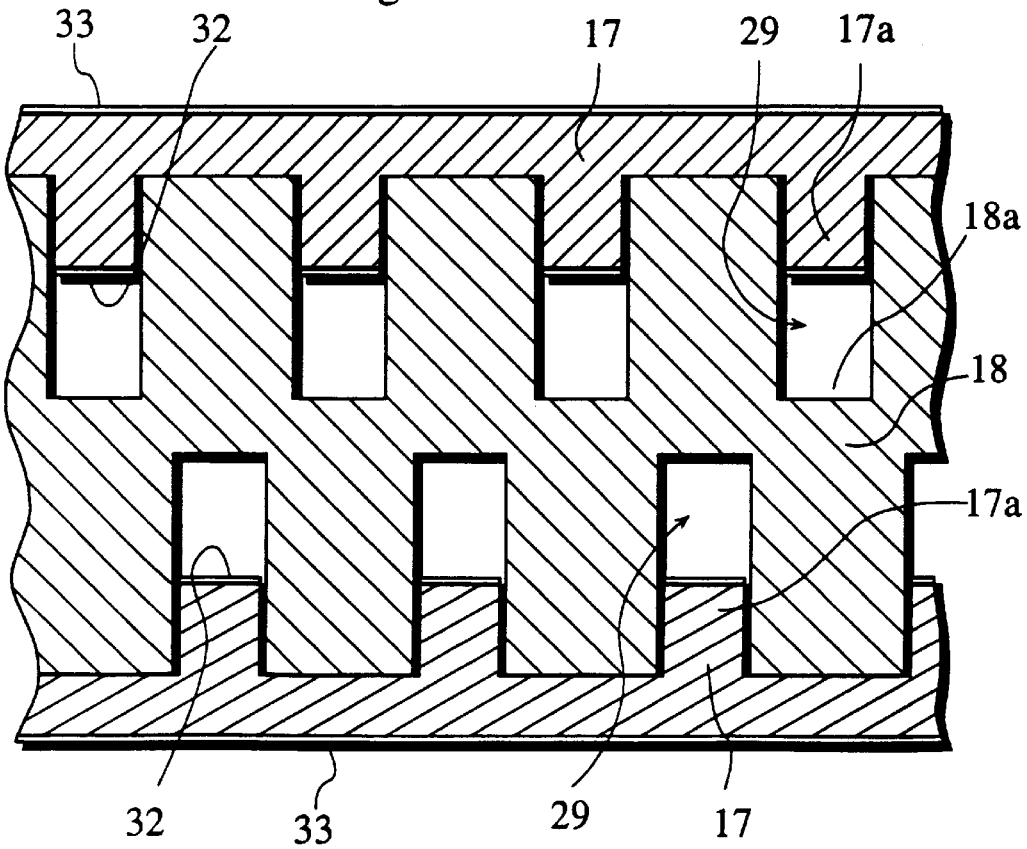
FIG. 20 is a cross sectional view of a fourth embodiment.

FIG. 20 is a cross-sectional view of a multi-nozzle head according to the fourth embodiment. As shown in FIG. 20, concave portion 18*a* are formed both on top and bottom of the non-piezoelectric member 18 staggeringly, and they are engaged with a pair of piezoelectric members 17, respectively.

In the multi-nozzle head thus constructed, the number of ink cavities 29 is increased; a side wall of the non-piezoelectric member 18 is strengthened; and the ink cavity 29 can be disposed at a smaller interval.

[Embodiment 5]

A fifth embodiment is a modification of the first embodiment, in which a non-piezoelectric member is inserted between piezoelectric members.

Figure 21:
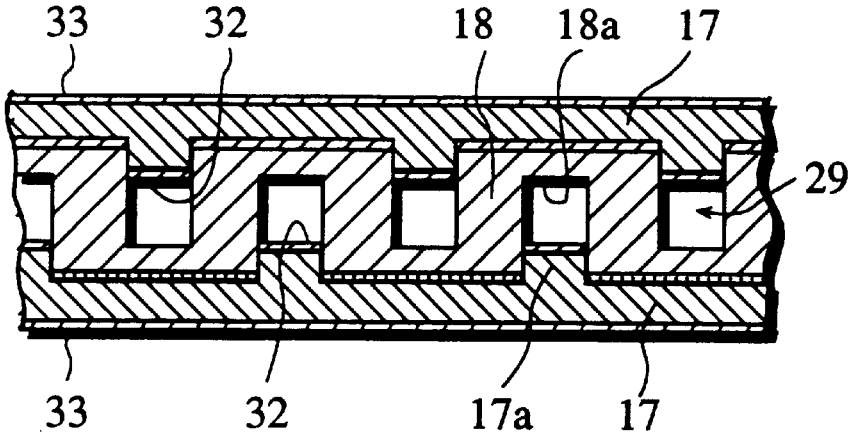
FIG. 21 is a cross-sectional view of a fifth embodiment.

FIG. 21 is a cross-sectional view of a multi-nozzle head according to the fifth embodiment. As shown in FIG. 21, a pair of piezoelectric members 17 are arranged in such a manner that convex portions 17*a* in the piezoelectric members 17 face to each other, and a non-piezoelectric member 18 is disposed between the piezoelectric members 17. Concave portions 18*a* in the non-piezoelectric member 18 to be engaged with the convex portions 17*a*, respectively are made of resin, and hence ink cavities 29 are arranged in parallel.

In this configuration, the non-piezoelectric member 18 can be made of resin, and the ink cavities 29 are disposed at a larger intervals, as a result of which effects from adjacent ink cavities can be minimized.

[Embodiment 6]

In a sixth embodiment a piezoelectric member is comprised of a plurality of piezoelectric chips laid on an insulating plate, and an individual electrode and an electrode are provided on both surfaces of the piezoelectric chip in such a manner they are confronted with each other.

Figure 22:
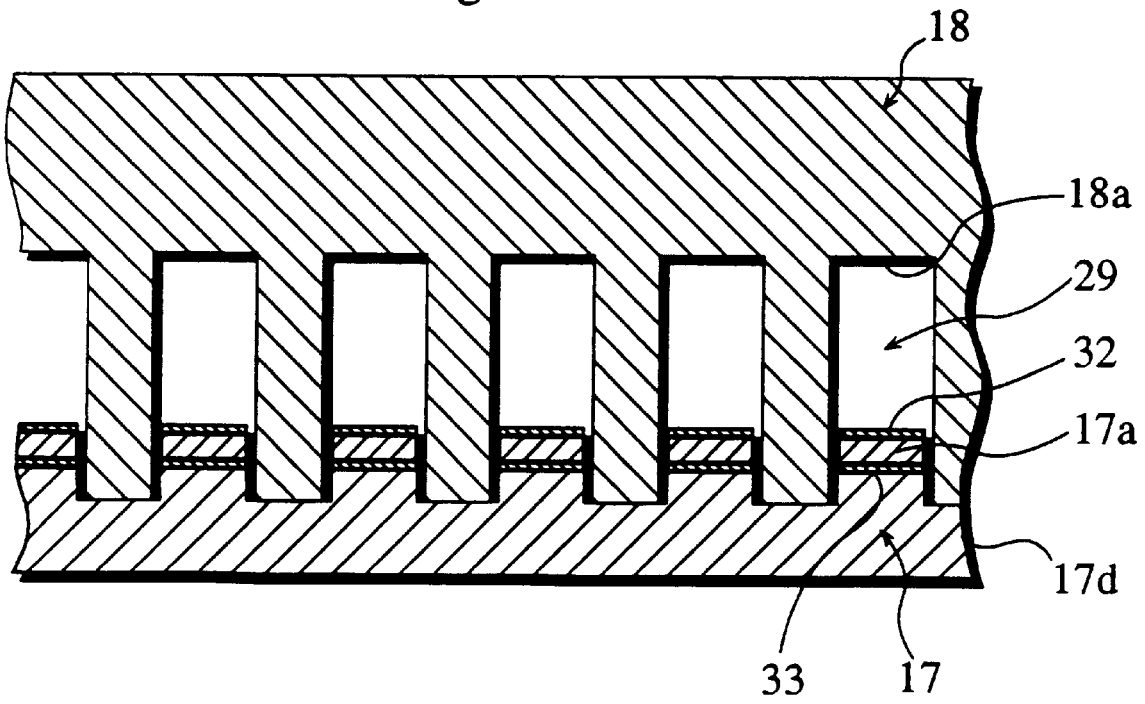
FIG. 22 is a cross-sectional view of a sixth embodiment.

FIG. 22 is a cross-sectional view of a multi-head nozzle according to this embodiment. The multi-nozzle head in this embodiment is substantially same as the multi-nozzle head in the first embodiment except the configuration of a piezoelectric member 17. That is, lower part of a convex portion 17*a* is a rigid insulating plate and upper part thereof is made of piezoelectric materials; and an individual electrode 32 and an electrode are disposed on top and bottom surface of the piezoelectric part respectively. The electrodes 33 correspond to the individual electrodes 32 one to one while the electrodes 33 in the area excluding any ink cavity are continuous as one electrode.

Substantially same as the first embodiment, the engagement of the piezoelectric member 17 and the non-piezoelectric member 18 constitutes the multi-nozzle head.

Figure 23:
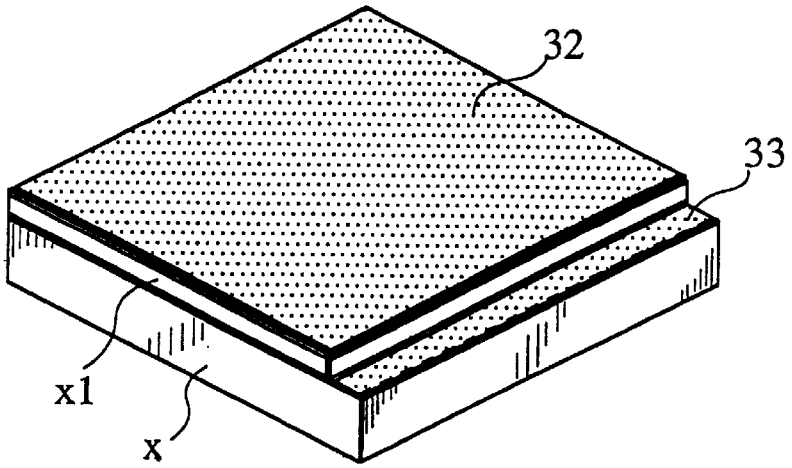
FIG. 23 shows a step of manufacturing a piezo-electric member according to the sixth embodiment.
Figure 24:
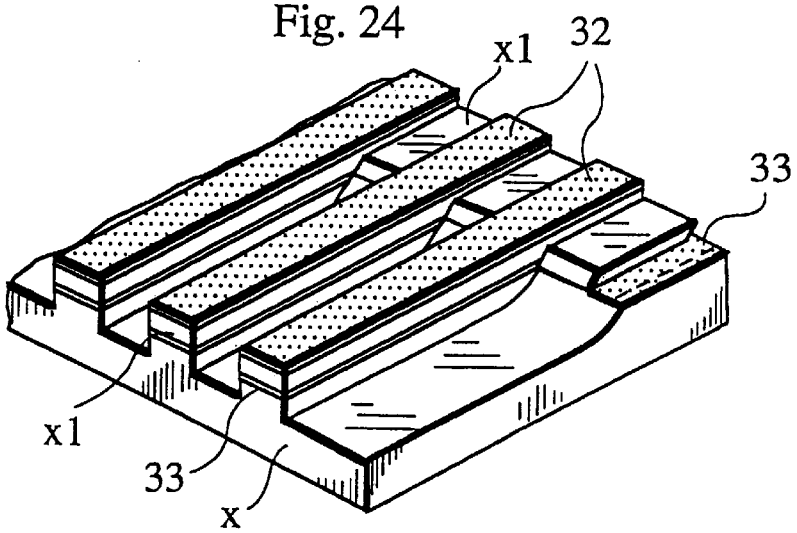
FIG. 24 shows a step of manufacturing a piezo-electric member according to the sixth embodiment.
Figure 25:
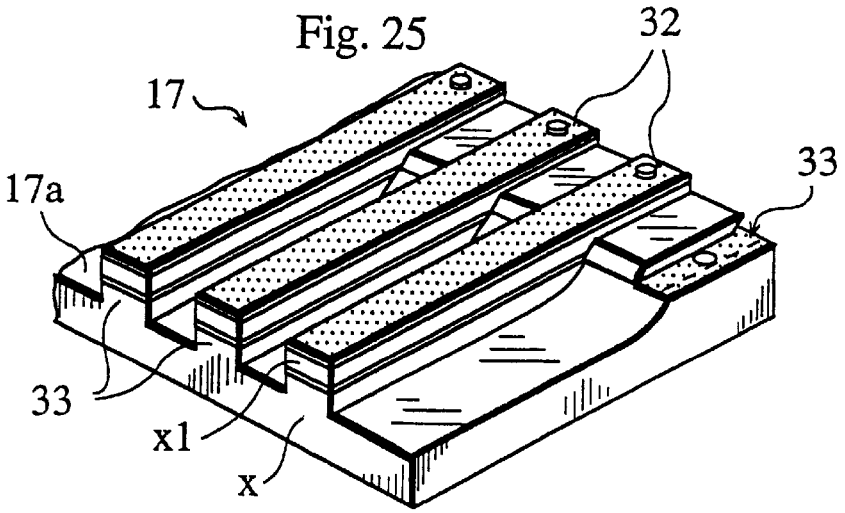
FIG. 25 shows a step of manufacturing a piezo-electric member according to the sixth embodiment.

FIGS. 23–25 show manufacturing steps of the piezoelectric member 17. As shown in FIG. 23, the electrodes 32 and 33 have been provided to top and bottom surface of a PZT thin layer X1 by Green sheet method; and the PZT thin layer X1 is fixed to an insulating rigid plate X with a conductive adhesive layer.

As shown in FIG. 24, the convex portion 17*a* to be engaged with a concave portion 18*a* in the non-piezoelectric member 18 is formed by cutting with a dicing saw as well the individual electrode 32 is provided on top surface of the convex portion 18*a*.

As shown in FIG. 25, a terminal connecting position is formed at a rear end of the individual electrode 32 and the electrode 33, and hence the piezoelectric member 17 is manufactured.

According to the multi-nozzle head thus constructed, a voltage is applied only across the concave portion 17*a* since the individual electrode 32 and the electrode 33 are provided on top and bottom surface of the piezoelectric concave portion 17*a*. Therefore, vibration is generated effectively and few electric field escapes are observed, therefore the applied voltage can be lowered remarkably. Also, the piezo electric member comprises only the convex portion 17*a*, so that vibration is hardly transmitted to adjacent ink cavities 29, as a result of which cross-talk between ink cavities can be prevented.

Figure 26:
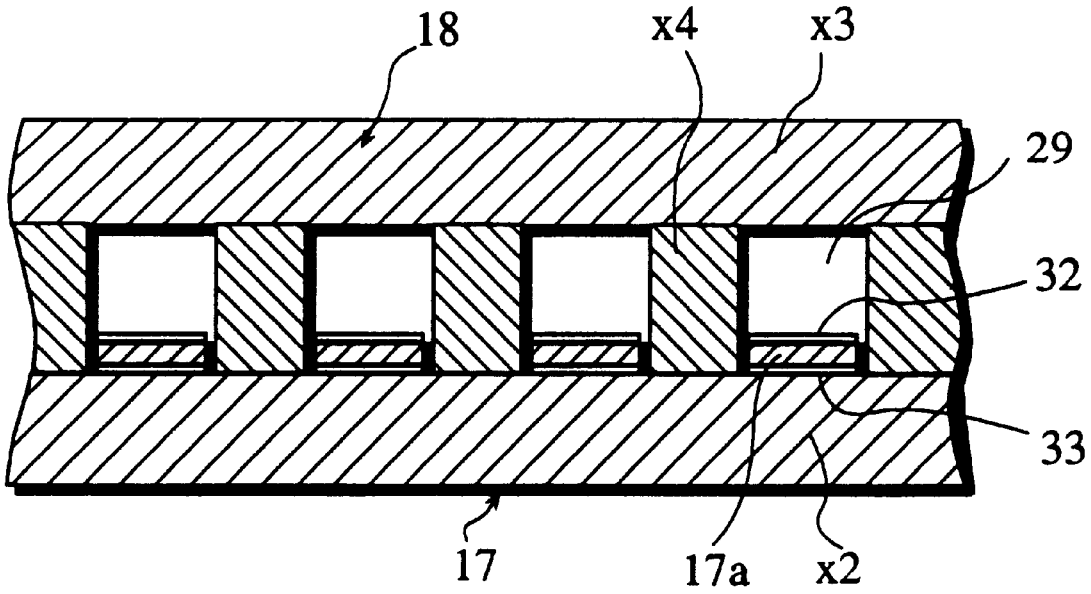
FIG. 26 is a cross-sectional view of a modification of the sixth embodiment.

FIG. 26 is a cross-sectional view of a multi-nozzle head which is a modification of the sixth embodiment. In the multi-nozzle head in FIG. 26, the convex portion 17*a* made for instance of a syntered body of PZT piezoelectric powder is formed on an alumina plate X2 or the like. The convex portion 17*a* is produced by applying application liquid where PZT piezoelectric powder has been dispersed to the alumina plate X2 (pattern application), then sintering the alumina plate X2.

A side wall X4 of the non-piezoelectric member 18 is made of a thick film photo resist. The side wall X4 is produced by pattern exposing and etching a thick film photo resist which has been applied to a plate X3.

The multi-nozzle head is produced by engaging the piezoelectric member 17 and non-piezoelectric member 18 thus constructed. Thus, cutting with a dicing saw is excluded in this embodiment; accordingly, the manufacturing cost of the multi-nozzle head in FIG. 26 can be reduced.

[Embodiment 7]

In a seventh embodiment, a piezoelectric member is made of a plurality of piezoelectric elements on an insulating plate.

Figure 27:
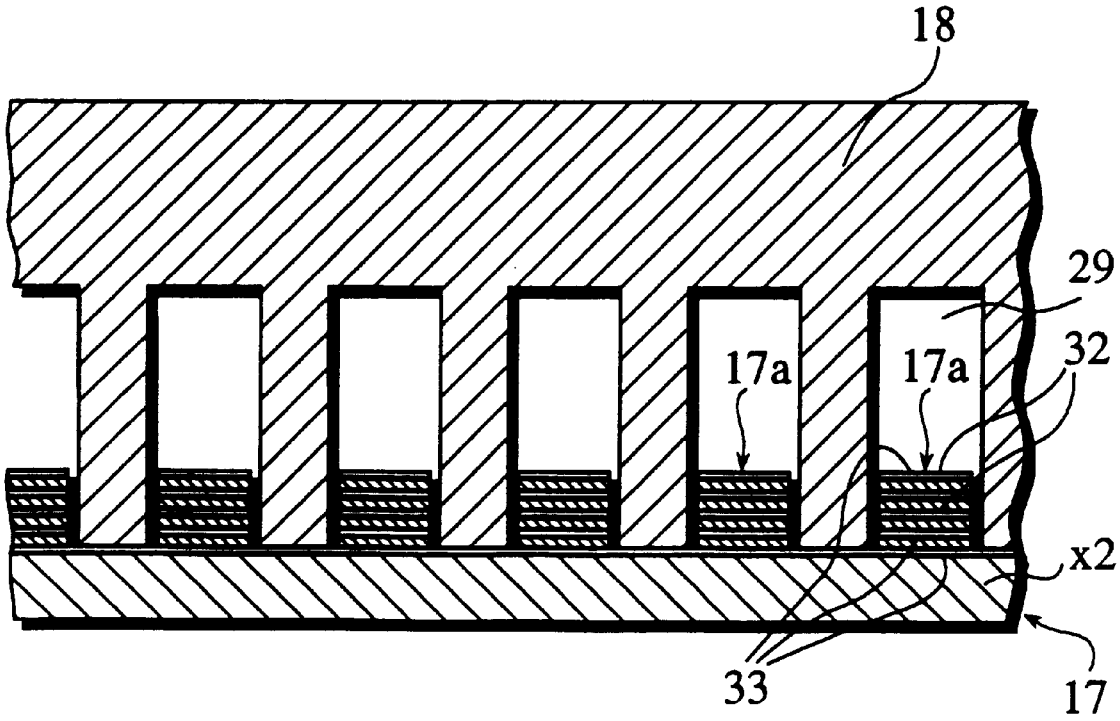
FIG. 27 is a cross-sectional view of a modification of the seventh embodiment.

FIG. 27 shows a cross-sectional view of a multi-nozzle head in this embodiment. As shown in FIG. 27, a convex portion 17*a* comprises a plurality of PZT piezoelectric layers, and electrode layers 32, 33 made for instance of palladium (four layers for each in the figure). In producing the convex portion 17*a*, the PZT piezoelectric layers, electrode layers 32, 33 are laid on each other by Green sheet method; wiring is provided to the electrode layers 32, 33; then the resulting multi-layer is cut into a predetermined size with a dicing saw. The multi-nozzle head is produced by engaging the piezoelectric member 17 thus constructed with the non-piezoelectric member 18 in the first embodiment.

According to this embodiment, deformation of the piezoelectric member by an applied voltage is increased in proportion to the number of the PZT piezoelectric layers, which therefore ink jetting is achieved with a low applied voltage, and the running cost can be reduced.

[Embodiment 8]

In an eighth embodiment, a piezoelectric member is made of piezoelectric materials, and a space between the piezoelectric member and a non-piezoelectric member is filled with an adhesive material.

Figure 28:
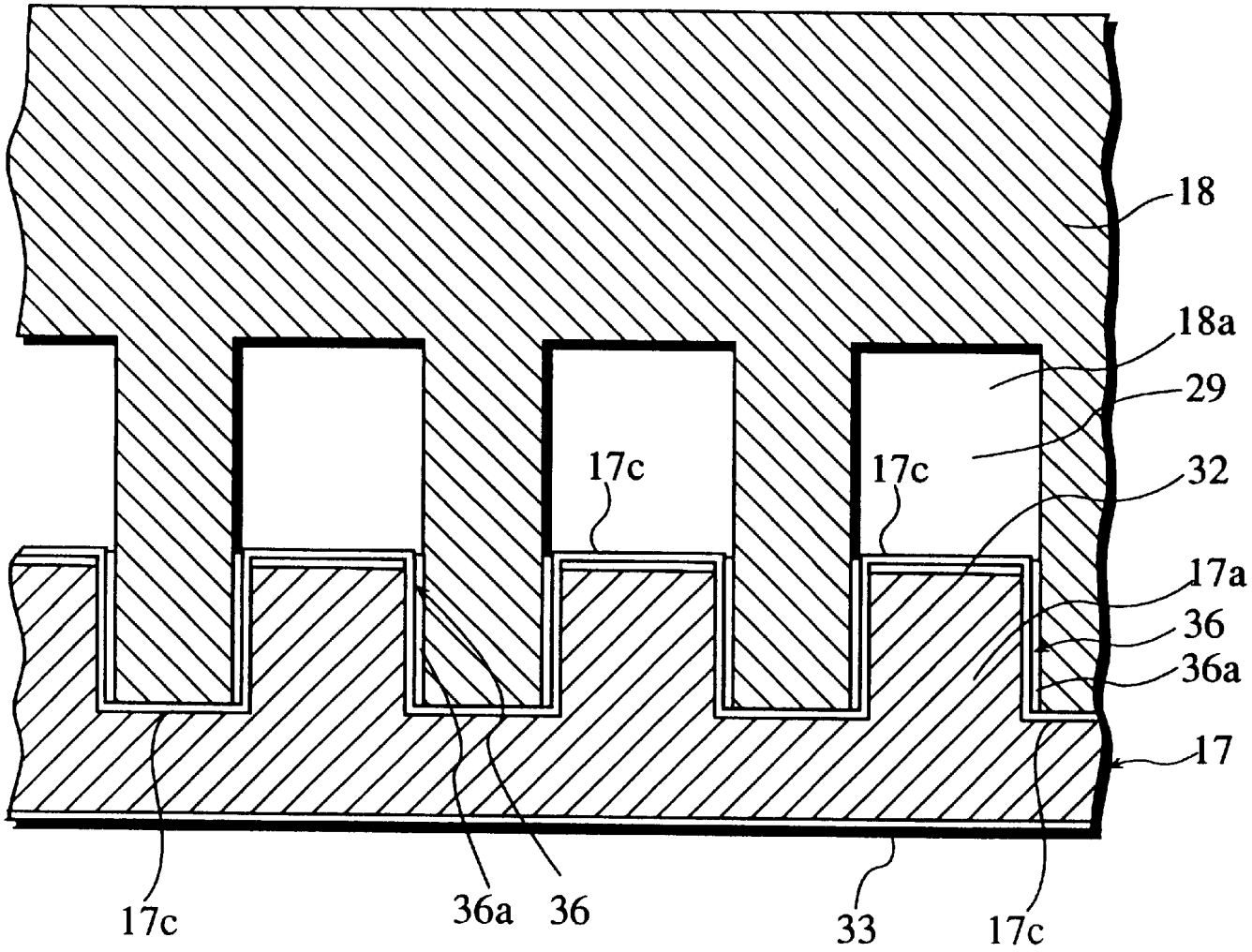
FIG. 28 is a cross-sectional view of an eighth embodiment.

FIG. 28 is a cross-section view of a multi-nozzle head in the eighth embodiment. The multi-nozzle head in this embodiment is substantially same as that in the first embodiment except that surface of a convex portion 17*a* in the piezo electric member 17 is covered with an insulating protection film 17*c* which is 10 $\mu$m in thickness and made of polyimide resin (HL-1110 by Hitachi Chemical Co., Ltd.), and a space 36 between a side of the convex portion 17*a* and a side of a concave portion 18*a* is filled with a filling and adhesive member 36*a* made of liquid epoxy adhesive (E30 by Konishi Co., Ltd.) together with an insulating protection film 17*c*.

Manufacturing of the multi-nozzle head in this embodiment is substantially same as the multi-nozzle head in the first embodiment illustrated by FIGS. 7–13 except the formation of the insulating protection film 17*c* and the filling of the space with the filling adhesive member 36*a*. The insulating protection film 17*c* is formed by applying polyimide resin to the piezoelectric member 17 by spincoat method, and sintering the application result at 180° C. for an hour. When engaging the piezoelectric member 17 and the non-piezoelectric member 18 with each other, the space 36 is filled with epoxy adhesive, and is syntered at 150° C. for half an hour.

This embodiment has the same advantage as the first embodiment in that vibration is hardly transmitted from the convex portion 17*a* to the non-piezoelectric member 18 since they are constructed independently from each other. Besides this, to fill the space 36 with the filling and adhesive member 36*a* and the insulating protection film 17*c* is advantageous in the followings.

Ink pressured by deformation of the piezoelectric member cannot enter the space 36, which therefore effective ink jetting is achieved.

Since ink is forbidden to enter a bulk in the piezoelectric member, lowering of a bulk resistance is prevented, and effective voltage is not decreased.

A cavitation at the space 36 upon vibration of the piezoelectric member can be prevented, and no bubbles are generated in the ink cavity. Therefore, air damper by bubbles is prevented, and ink jetting is operated effectively. Also, the filling and adhesive member 36*a* for filling the space 36 can be functioned as the insulating protection film 17*c*, so that the insulating protection film 17*c* can be omitted from the multi-nozzle manufacturing procedure. Further, the piezoelectric member 17 and the non-piezoelectric member 18 are fixedly secured to each other with the filling and adhesive member 36*a* as adhesive.

The insulating protection film 17*c* can be generated by the following procedures (10)–(14).

(10) Application of plastics:

thermoplastic resin such as saturated polyester resin, polyamide resin, acrylic resin, (aramido resin), ethylenevinyl acetate resin, ion bridging olefin polymerization (ionomer), styrene-butadiene block polymerization, polyacetal, polycarbonate, vinyl chloride-vinyl acetate polymerization, cellulose ester, polyimide, or styrol;

thermosetting resin such as epoxy resin, phenoxy resin, urethane resin, nylon, silicone resin, fluoro silicone resin, phenolic resin, melamine resin, xylene-formaldehyde resin, alkyd resin;

photoconductive resin such as poly(vinylcarbazole), poly (vinylpyrene), poly(vinylanthracene), or poly (vinylor???).

These materials for plastics may be utilized by itself, or in combination.

Also, a mixture of engineering plastics such as liquid crystal polymer and powder whisker may be utilized.

Photosensitive resin, thick-film use photoresist resin, or the like may be utilized. It may be bakelite, fluororesin, or glass.epoxy resin (glass filler is mixed in epoxy). The application is operated by well known application methods such as application, dip, or spray.

Particularly, polyamide resin, aramido resin, epoxy resin, phenoxy resin, fluoro silicone resin, fluororesin, glass.epoxy resin are the most effective among the all materials.

(11) evaporating of metal oxide.nitride.sulfide compound

A metal oxide compound (e.g., $SiO_2$, SiO, CrO, $Al_2O_3$), a metal nitride compound (e.g., $Si_3N_4$, AlN), a metal sulfide compound (e.g., ZnS), or an alloy of these metals is coated by vacuum evaporation or spattering. Otherwise, the above listed plastics (10) may be applied or pariren???resin evaporated to these metals.

Particularly, $Al_2O_3$ and $Si_3N_4$ are superior to the other materials in the above.

(12) application of hydrocarbon

The insulating protection film is formed by applying the group IV element content hydrocarbon such as hydrocarbon, oxygen content hydrocarbon, or sulfur content hydrocarbon; halogen content hydrocarbon such as nitrogen content hydrocarbon, silicon content hydrocarbon, or fluorine content hydrocarbon; or the group III element content hydrocarbon by P-CVD (plasma CVD). Otherwise, a mixture thereof may be applied by P-CVD. Particularly, fluorine content hydrocarbon is superior to the others in the above.

Depending on the adhesive strength between the insulating protection film and the piezoelectric member, an undercoat made for instance of a-Si (amorphous silicon), a-SiC, a-SiN is required.

(13) Instead of applying the application liquid made of the plastics (10) to the surface of the piezoelectric plate, the piezoelectric plate is impregnated with the application liquid under a reduced pressure.

(14) The surface of the piezoelectric plate is treated with an ink-development solvent.

The insulating protection films produced by the above (11)–(14) are compared to each other in the following characteristics (In the case of (12), an undercoat is formed).

strength: strong (12), (11)>(10), (13)>(14) weak smoothness: good (10)>(13)>(12), (11), (14) bad adhesive strength (vibration proof):
strong (10), (13)>(11), (12)>(14) weak durability (ink proof) : good (10), (13)>(11), (12)>(14) bad The surface treatment at (14) is convenient, and it can be operated after any of (10)–(13). In view of manufacturing cost, (10) and (13) are less expensive than the others. Also, depending on a type of employing piezoelectric member or ink, a combination of (11)–(14) may be used.

The filling and adhesive member 36*a* may be made of the following materials instead of the epoxy adhesive described in the above.

(15) thermosetting resin (e.g.) epoxy resin, phenoxy resin, urethane resin, nylon, silicone resin, fluoro silicone resin, phenolic resin, melamine resin, xylene-formaldehyde resin, alkyd resin Particularly, epoxy resin, phenoxy resin, and fluoro silicone resin are superior to the others in the above examples.

(16) thermoplastic resin (e.g.) saturated polyester resin, polyamide resin, acrylic resin, aramido resin, ethylene-vinyl acetate resin, ionomer, styrene-butadiene block polymerization, polyacetal, polycarbonate, vinyl chloride-vinyl acetate polymerization, cellulose ester, polyimide, styrol Particularly, aramido resin, polyimide, polyamide resin, ethylene-vinyl acetate resin are superior to the others in the above.

(17) liquid crystal polymer

(18) photoconductive resin, thick film photoresist resin

(19) rubber, synthetic rubber

The materials listed in (15)–(19) may be used itself alone, or in combination; otherwise, they may be combined with other materials such as other powder, whiskers, or glass filler.

Among the above materials listed in (15)–(19), (15) and (17) are the most effective, and (18) is more effective than (19). [(15)–(17)>(18)>(19)]

[Embodiment 9]

In a ninth embodiment, conductive treatment is applied to a plate part of a piezoelectric member, and a space is filled with a filling member.

Figure 29:
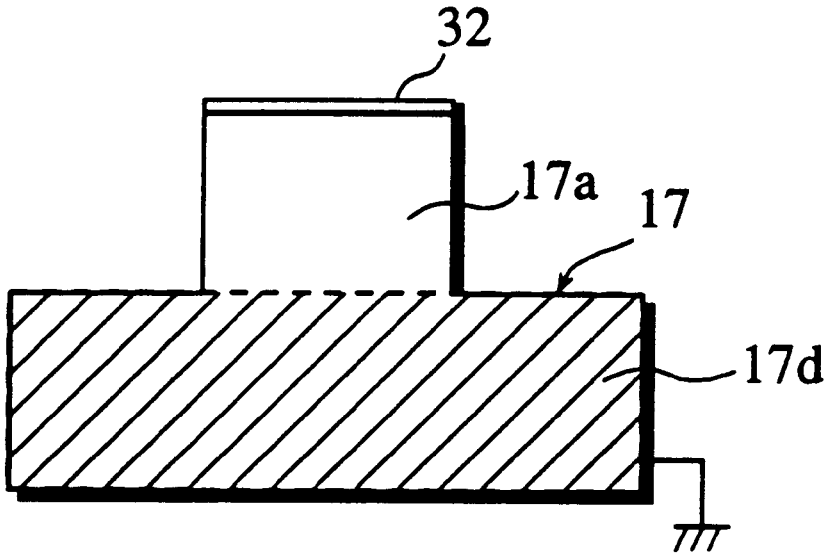
FIG. 29 is a cross-sectional view of a ninth embodiment.

FIG. 29 is a cross-sectional view of a piezoelectric member 17 in a multi-nozzle head according to the ninth embodiment. The multi-nozzle head herein is substantially same as the multi-nozzle head in the eight embodiment except that it does not include the electrode 33, also a conductive treatment is applied to a plate part 17*d* of the piezoelectric member 17 with Ag.

The manufacturing of the piezoelectric member is described hereunder. Masking is applied to one surface (top surface in FIG. 29) of a PZT piezoelectric plate (N-21 by Tokin, thickness=0.5 mm); and a paste comprised of zirconium powder blended into silver paste (NP-4910 by Noritake) is applied to the other surface (bottom surface in FIG. 29) in 200 μm thick, and thermal diffusion is operated in vacuo at 500° C. for an hour. By doing thermal diffusion, the metal in the paste diffuses from the surface to around 150 μm inward, and hence conductive treatment is applied to almost everywhere in the plate part 17*d*. Then, at room temperature, an Au/Ni.Cr spatter film is formed on the first mentioned surface (top surface in FIG. 29); the plate part 17*d* is polarized; and the plate part 17*d* is cut into a predetermined size.

The polarization may be operated by evaporating Zr or Cu instead of Ag.

By applying conductive treatment to the piezoelectric plate part 17*d*, the conductive film which is equivalent to the electrode 33 in the eighth embodiment is formed thereon; therefore, the electrode 33 is excluded in the ninth embodiment. Also, the voltage applied to the plate part 17*d* is reduced, which therefore voltage application to a convex part 17*a* becomes more effective.

[Embodiment 10]

In a tenth embodiment, a plurality of piezoelectric chips are provided on a conductive plate, and a space is filled with filling.

Figure 30:
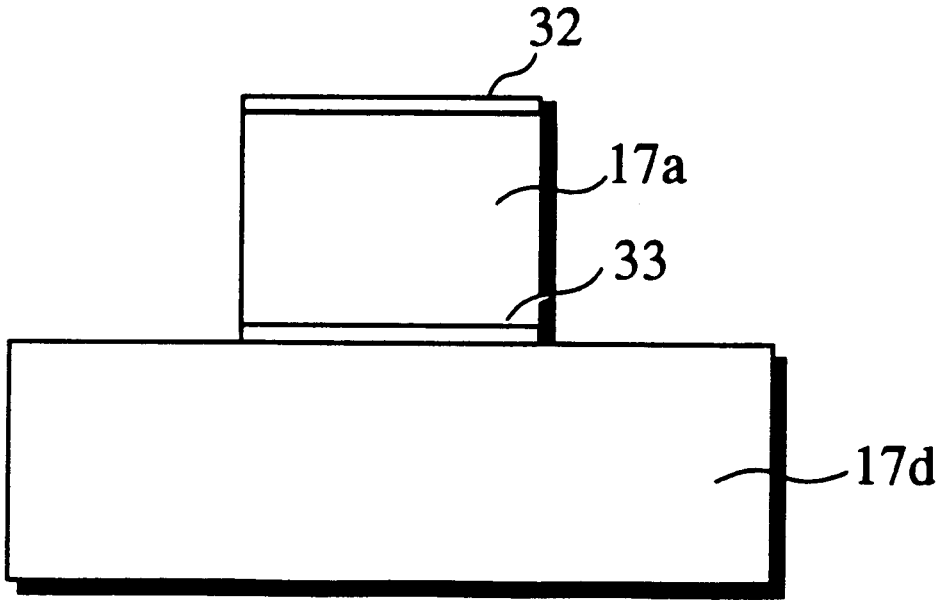
FIG. 30 is a cross-sectional view of a tenth embodiment.

FIG. 30 is a cross-sectional view of a piezoelectric member 17 of a multi-nozzle head according to the tenth embodiment. The multi-nozzle head herein is substantially same as the multi-nozzle head in the eighth embodiment except that a plate part 17*d* of a piezoelectric member 17 is a conductive plate produced by applying conductive paste (NP-4909 by Noritake) which is 40 μm in thickness to a Cu plate which is 3 mm in thickens. A convex portion 17*a* is made of PZT (H5D, thickness=0.2 mm by the Sumitomo Metal Industries, Ltd.). An individual electrode 32 and an electrode 33 are Au/Ni layers formed on both surfaces of the convex portion 17*a*.

In producing the piezoelectric member 17, a conductive paste is applied to a Cu plate X; a PZT plate X1 where metal plating has been applied to both top and bottom surfaces with Au/Ni is disposed on the Cu plate; it is heat cured at 150° C. for half an hour; then it goes thorough the same manufacturing procedures in the second embodiment which are shown in FIG. 23–25.

The plate part 17*d* may be comprised for instance of Al, Au, Ni, instead of Cu.

[Embodiment 11]

In an eleventh embodiment, between a plate part of a piezoelectric member and a non-piezoelectric concave portion a space exists, and the space is filled with filling.

Figure 31B:
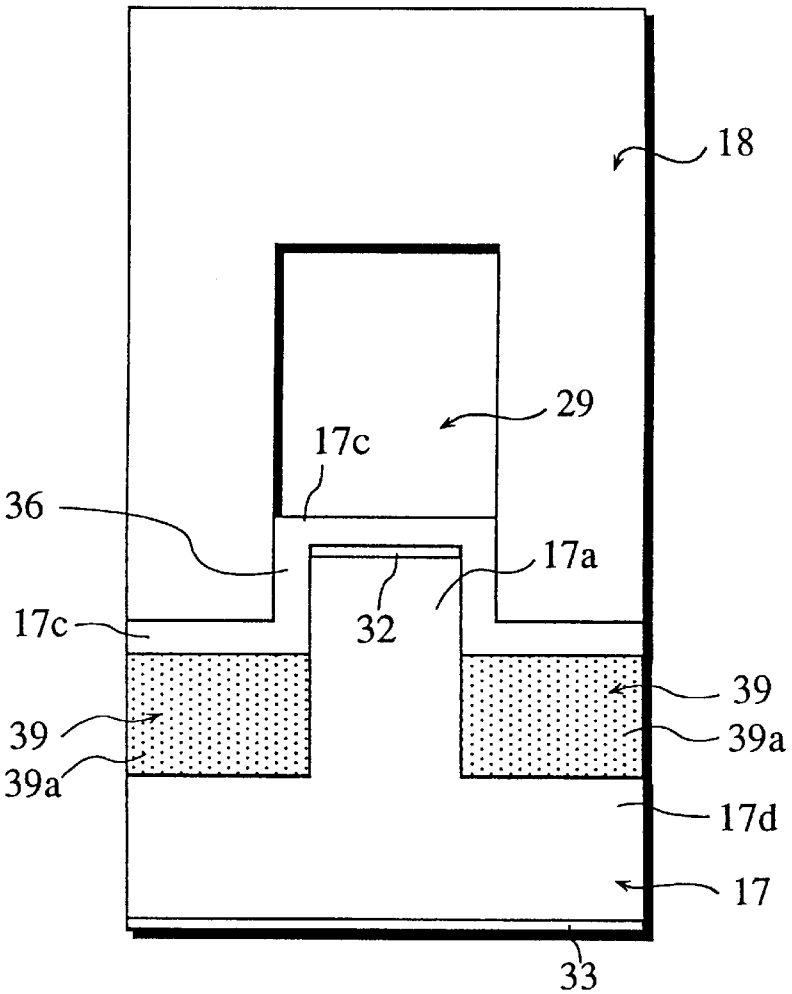
FIGS. 31 (*a*) and (*b*) is a cross-sectional views of an eleventh embodiment and a twelfth embodiment.
Figure 31A:
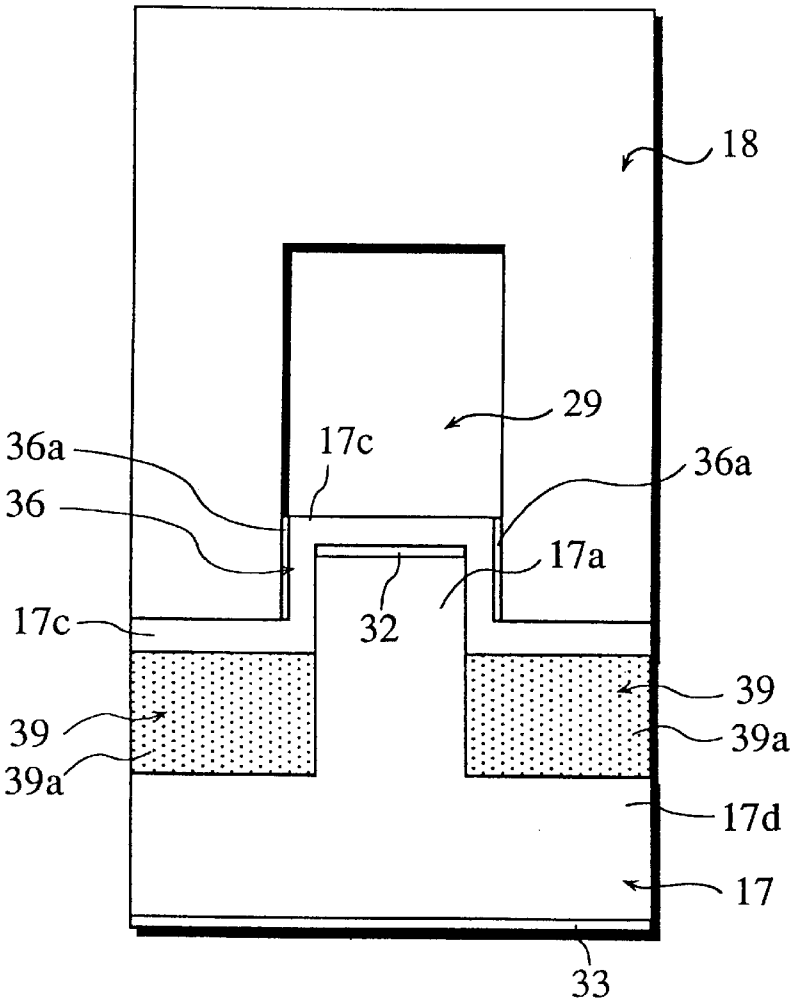

FIG. 31 (*a*) is a cross-sectional view of a multi-nozzle head in the eleventh embodiment. The multi-nozzle head in this embodiment is substantially same as the multi-nozzle head in the eighth embodiment except the followings.

In the piezoelectric member 17, a ratio in the thickness of a convex part 17*a* to a plate part 17*d* is 7:3; and the total thickness of the piezoelectric member 17 is 0.5 mm.

A part of the piezoelectric member 17 is engaged with the non-piezoelectric member 18 as shown in FIG. 31 (*a*), and a space 39 exists between the plate part 17*d* and the convex part of the non-piezoelectric member 18. The space 39 is filled with a filling and adhesive member 39*a* and the insulating protection film 17*c*. The piezoelectric member 17 is made of PZT (N-21 by Tokin); phenoxy resin (JA-7405 by 3M) is used as the filling and adhesive member 36*a*; and an epoxy resin film is employed as the insulating protection film 17*c* (CG-105 (W) tape type adhesive of 50 μm in thickness by Nichiban Co., Ltd).

In manufacturing the multi-nozzle head, the piezoelectric member 17 is covered with the insulating protection film 17*c*; a part of the piezoelectric member 17 is engaged with the non-piezoelectric member 18, and the engagement is fixed by filling a space 36 with a filling and adhesive member 36*a* as well as filling the space 39 with the filling and adhesive member 39*a* so that the space 39 is filled with the adhesive member 39*a* and the insulating protection film 17*c*, and heating at 150° C. for half an hour to harden the insulating protection film 17*c* and the filling and adhesive member 36*a*.

In the multi-nozzle according to the eleventh embodiment, it is not necessary to fully engage the piezoelectric member 17 and the piezoelectric member 18; therefore, components are hardly damaged during fabrication, and manufacturing cost can be reduced remarkably.

The filling and adhesive member 39*a* may be made of the materials (15)–(19) for the filling and adhesive member 36*a* in the eighth embodiment.

[Embodiment 12]

An embodiment 12 is substantially same as the eleventh embodiment except that a space 36 between a side of a convex portion 17*a* in a piezoelectric member 17 and a side of a concave portion in a non-piezoelectric member 18 is filled only with an insulating protection film 17*c* as shown in FIG. 31 (*b*). Stated otherwise, a filling and adhesive member 36 is not employed herein.

In producing a multi-nozzle head, the piezoelectric member 17 is covered with the insulating protection film 17*c*, and a part of the piezoelectric member 17 is engaged with the non-piezoelectric member. Also, by inserting a filling and adhesive member 39 into a space 39, the engagement is fixed, and by heating the filling and adhesive member 39 at 150° C. for half an hour, the insulating protection film 17*c* and the filling and adhesive member 36*a* are hardened.

Thus, the same effects in the eighth embodiment where the space 36 is filled both with the filling and adhesive member 36*a* and the insulating protection film 17*c* can be achieved by filling the same only with the insulating protection film 17*c* made of an epoxy resin film.

[Embodiment 13]

In a thirteenth embodiment, a piezoelectric member is comprised of a plurality of piezoelectric convex portions provided on a conductive plate; there exists a space between a convex in a non-piezoelectric member and a plate part in the piezoelectric member; and the space is filled with a filing member.

Figure 32:
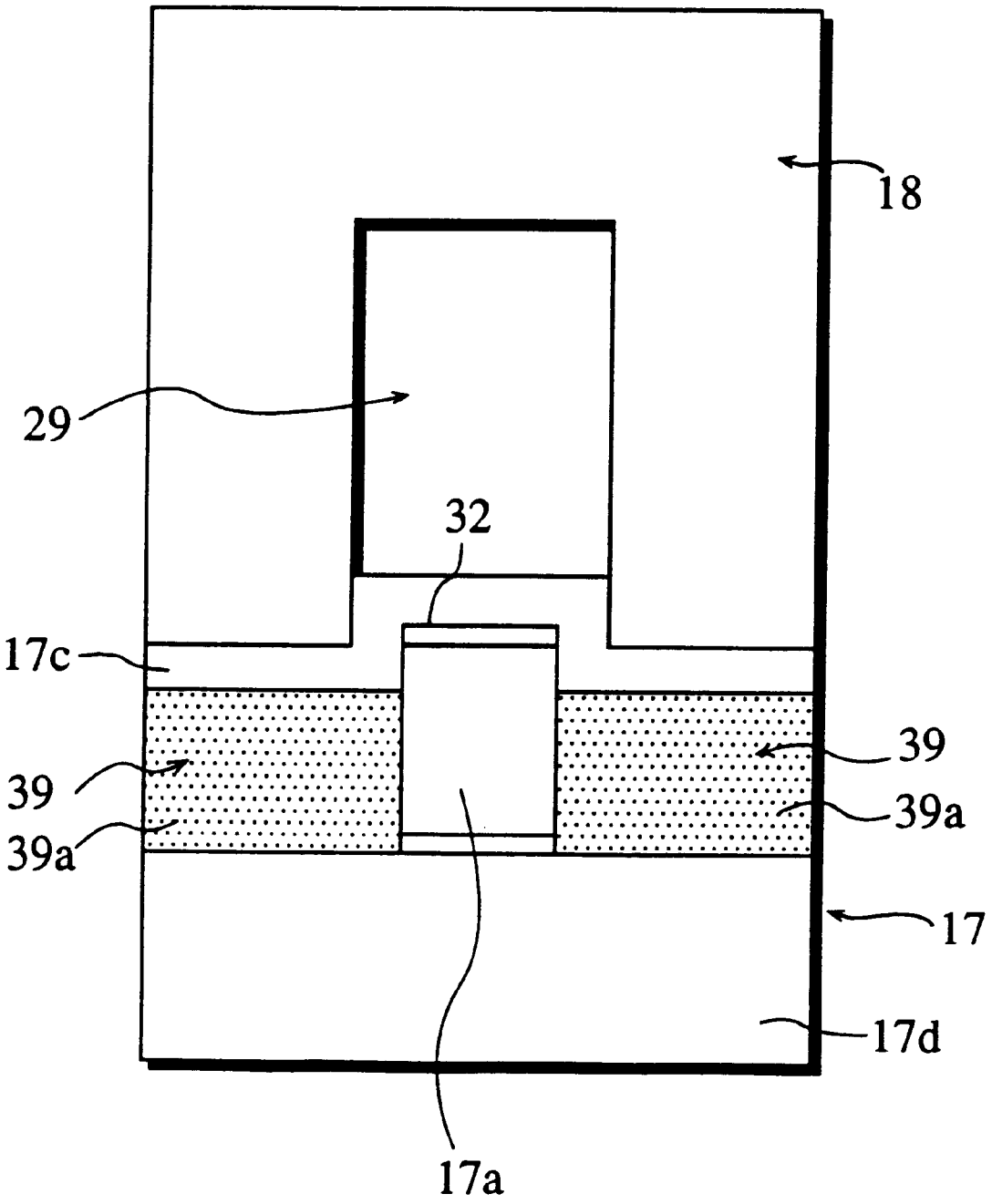
FIG. 32 is a cross-sectional view of a thirteenth embodiment.

FIG. 32 is a cross-sectional view of a multi-nozzle head in the thirteenth embodiment, which is substantially same as the multi-nozzle head in the eighth embodiment except the following points.

Substantially same as the piezoelectric member 17 in the tenth embodiment, a piezoelectric member 17 is comprised of a plate part 17*d* made of a conductive plate and a convex part 17*a* made of PXT, and an individual electrode 32 and an electrode 33 being Au/Ni layers are provided to top and bottom surfaces of the convex part 17*a*. The convex part 17*a* of the piezoelectric member 17 is covered with an insulating protection film 17*c* made of an aramido resin film (TX-I series, thickness=4 $\mu$m by Toray Industries, Inc.) A space 36 between a side of the convex part 17*a* in the piezoelectric member 17 and a concave part in the non-piezoelectric member 18 is filled only with the insulating protection film 17*c*. Since the piezoelectric member 17 and the non-piezoelectric member 18 are not fully engaged with each other, there exists a space 39 (about 200 $\mu$m) between the plate part 17*d* in the piezoelectric member 17 and a convex part in the non-piezoelectric member 18. The space 39 is filled with a filling and adhesive member 39*a* made of drop-type fluoro silicone resin (RTV rubber FE-61 by Shin-Etsu silicone Co., Ltd.) and the insulating protection film 17*c*.

The same effects in the eight embodiment where the space 36 is filled both with the filling and adhesive member 36*a* and the insulating protection film 17*c* are achieved by filling the space 36 only with the insulating protection film 17*c* made of an aramido resin film.

In producing the multi-nozzle head, silicon resin is applied to the piezoelectric member 17 with a bar coater until the convex portion 17*a* is sunk under the fluoro silicon resin; the piezoelectric member 17 is covered with the insulating protection film 17*c*, and is engaged with the non-piezoelectric member 18; then it is left at room temperature 25° C.) for 24 hours to harden the fluoro silicon resin.

Being the same as the eleventh embodiment, components are hardly damaged during fabrication, and manufacturing cost can be reduced remarkably.

The piezoelectric member 17 in this embodiment may be substituted by the one in the seventh embodiment where the convex portion 17*a* is multi-layer configuration including the PZT piezoelectric layers and the electrodes 32, 33 made of palladium laid on the alumina plate X2. In this case, deformation of the piezoelectric member is increased in proportion to the number of the piezoelectric layers, which therefore effective ink jetting is achieved with a low applied voltage, and running cost can be reduced.

[Embodiment 14]

In a fourteenth embodiment, engagement between a piezoelectric member and a non-piezoelectric member is fastened by molding.

Figure 33:
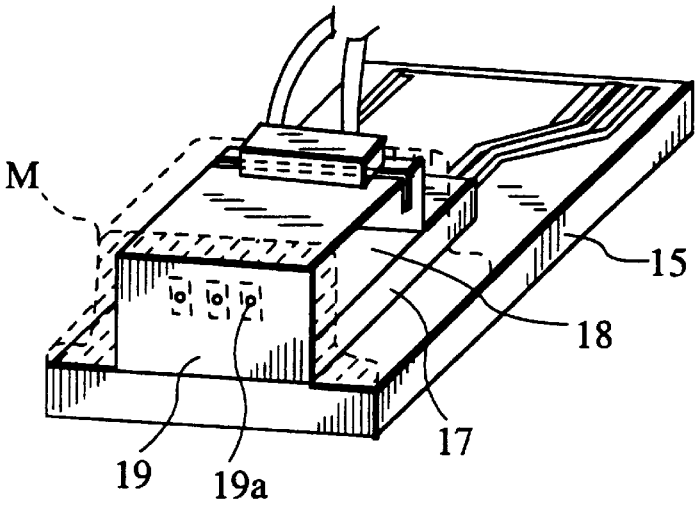
FIG. 33 is a perspective view of a fourteenth embodiment.

FIG. 33 is a cross-sectional view of a multi-nozzle head in the fourteenth embodiment. The multi-nozzle head herein is the same as the multi-nozzle head 13 in the first embodiment except that the engagement between a piezoelectric member 17 and non-piezoelectric member 18 is fixed by resin molding M their outer surface integrally.

The fixation by molding can also be employed in Embodiments 2–13.

Such molding provides an easy and practical way of fixing the engagement between the piezoelectric member 17 and non-piezoelectric member 18.

[Embodiment 15]

In a fifteenth embodiment, an engagement between a piezoelectric member and a non-piezoelectric member is fixed without adhesive.

Figure 34:
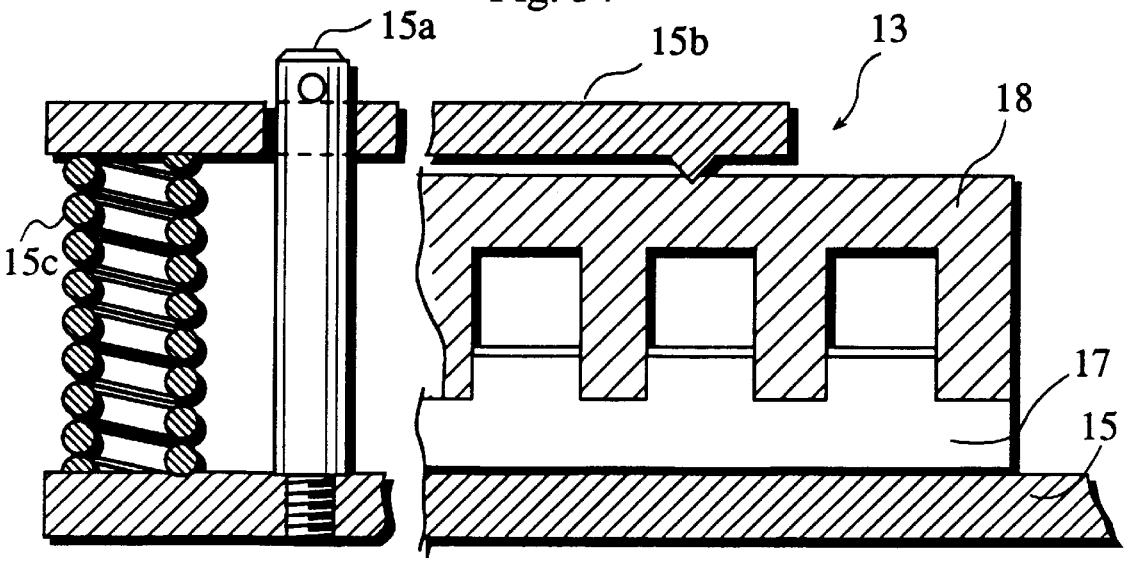
FIG. 34 is a perspective view of a fifteenth embodiment.

FIG. 34 is a cross-sectional view of a multi-nozzle head in the fifteenth embodiment. The multi-nozzle herein is the same as the multi-nozzle head in the first embodiment except that the piezoelectric member 17 and the non-piezoelectric member 18 which are engaged with each other in their convex and concave parts are disposed on a base plate 15. Also a pillar 15*a* stands on the base plate 15*a*, and the pillar 15*a* supports an arm 15*b* to move the arm up and down. One end of the arm 15*b* is in contact with the upper surface of the non-piezoelectric member 18 and a compression spring 15*c* is disposed between the bottom surface of the arm 15*b* and the upper surface of the base plate 15, particularly the compression spring is placed at the other end of the arm 15*b*. In this construction, the non-piezoelectric plate 18 is compressed to be engaged with the piezoelectric plate 17 by utilization of the spring's elasticity, and the engagement is fixed.

The multi-nozzle head 13 becomes compatible owing to this fixation.

[Embodiment 16]

In a sixteenth embodiment, an ink supplying unit includes a non-return valve or a switch valve.

Figure 35:
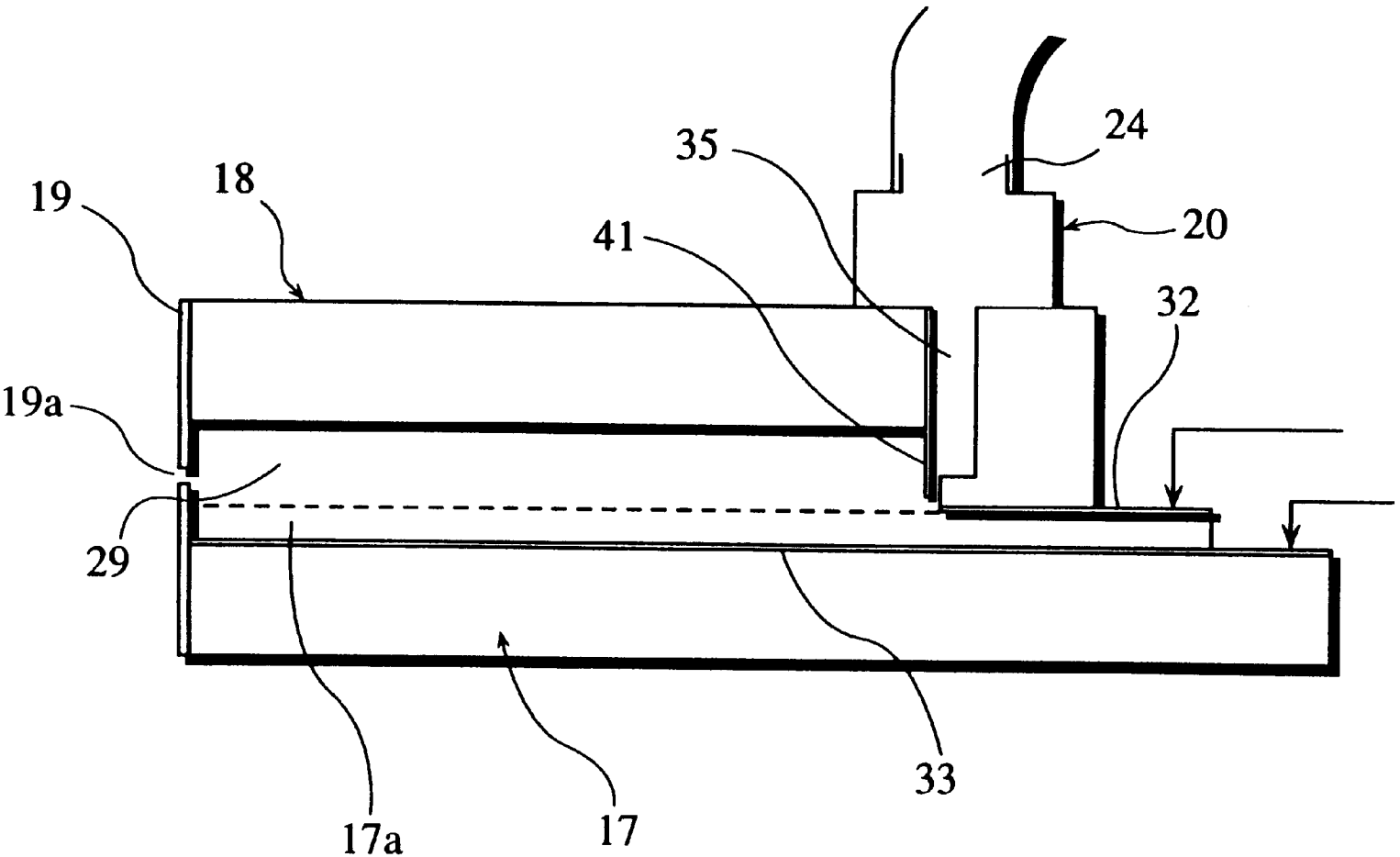
FIG. 35 is a longitudinal-sectional view of a sixteenth embodiment.
Figure 36:
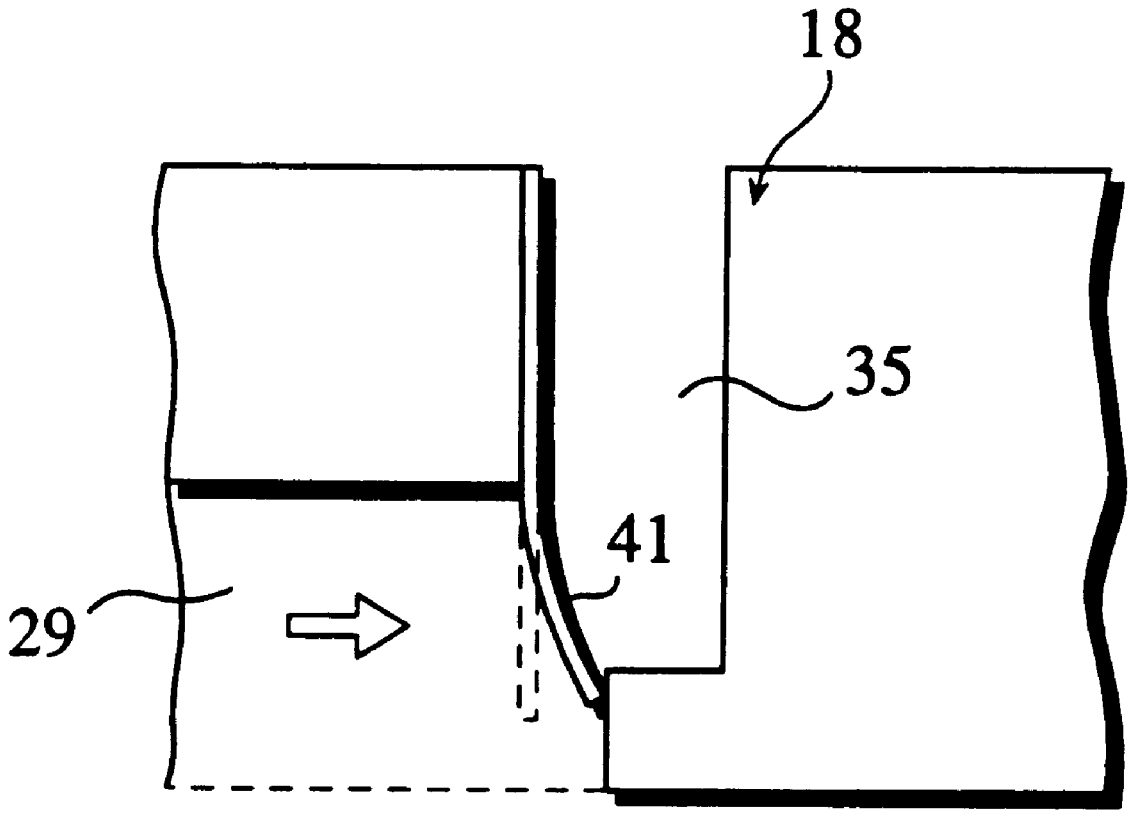
FIG. 36 is an enlarged view of an ink-supplying inlet in FIG. 35.

FIG. 35 is a cross-sectional view of a multi-nozzle head in this embodiment, and FIG. 36 is an enlarged view of the ink supplying unit.

The multi-nozzle head in this embodiment is substantially same as the multi-nozzle head 13 in the first embodiment except that a non-return valve 41 is placed at an ink path for communicating an ink supplying inlet 35 with an ink cavity 29 as shown in FIG. 35.

Upon applying a voltage to a convex portion 17*a* in a piezoelectric member, ink in the ink cavity 29 is jetted from an ink nozzle 19*a* while the non-return valve 41 blocks the ink path between the ink supplying inlet 35 and the ink cavity 29. Due to the non-return valve 41, pressure loss can be minimized, and ink jetting efficiency is improved. Thus, the loss of pressure is prevented, so that an applied voltage and running cost can be decreased.

A switch valve may substitute for the return valve. The return valve or switch valve thus operated can be employed in Embodiment 2–15.

[Embodiment 17]

In a seventeenth embodiment, a panel heater is mounted on a multi-nozzle head.

Figure 37:
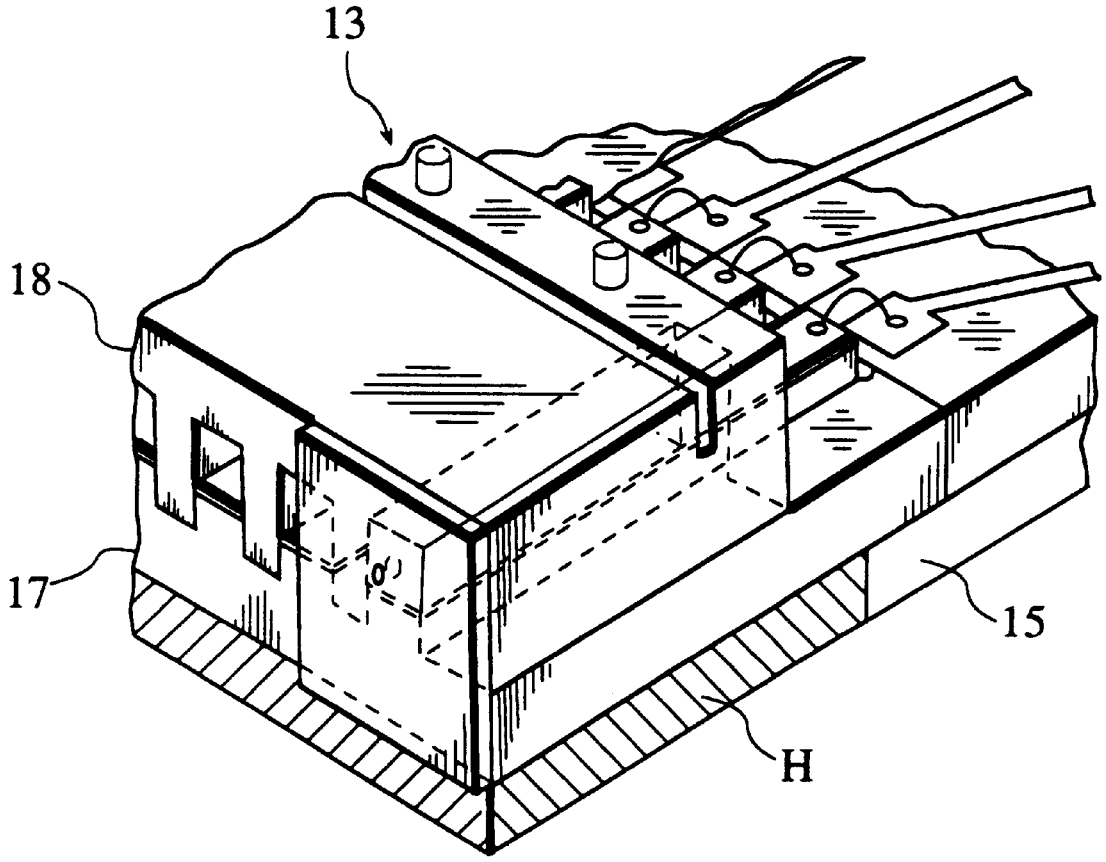
FIG. 37 is a perspective view of a seventeenth embodiment.
Figure 38A:
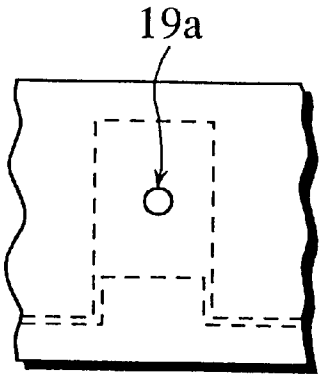
FIG. 38 (*a*) to (*i*) shows an ink nozzle of the embodiment.
Figure 38B:
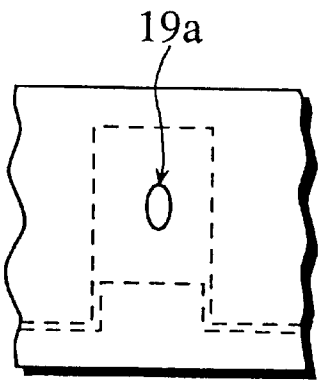
Figure 38C:
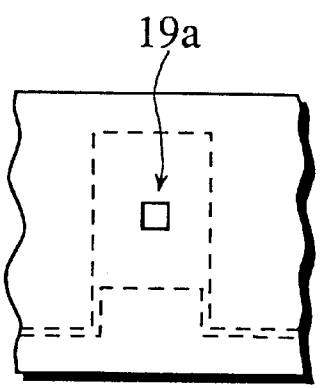
Figure 38D:
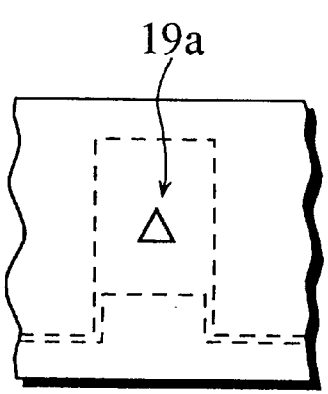
Figure 38E:
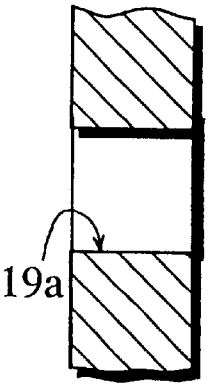
Figure 38F:
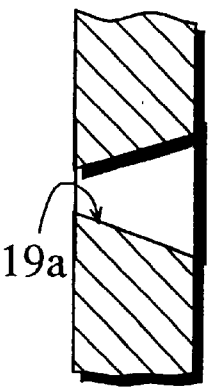
Figure 38G:
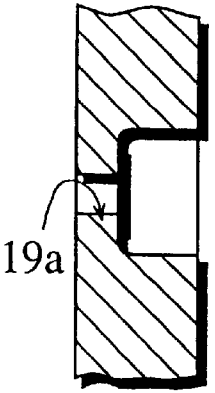
Figure 38H:
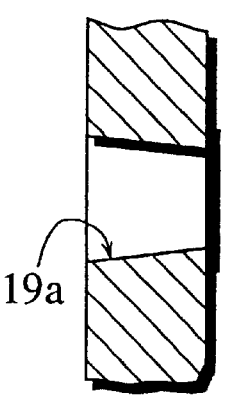
Figure 38I:
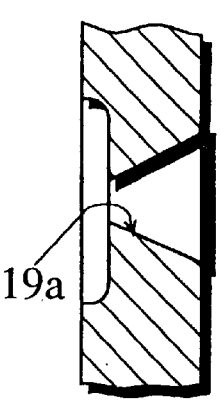

FIG. 37 is a perspective view of the multi-nozzle head in this embodiment. This embodiment is a modification of the multi-nozzle head in the first embodiment where a panel heater H which is a ceramic heater is mounted on the bottom surface of the multi-nozzle head 13.

Because of the panel heater H, surface tension and viscosity of ink remains stable regardless of outside air temperature, accordingly stable ink jetting is achieved.

The panel heater may be mounted on the multi-nozzle heads in Embodiments 2–16.

[Others]

The piezoelectric materials, the non-piezoelectric materials in the first embodiment, and the insulating film materials, the filling and adhesive materials in the eighth embodiment can be employed in any of the above embodiments.

Although in Embodiment 1–7 the space 36 is formed between the side of the piezoelectric convex portion and the non-piezoelectric concave portion, the same effects of preventing the bulkhead vibration by the electric field and preventing the deformation of the bulkhead can be achieved without making a space as long as the convex portion and the concave portion can slide.

Even when the piezoelectric convex portion and the non-piezoelectric concave portion are not slidable, it is possible to jet ink if the piezoelectric concave portion is deformed by an applied voltage. In this case, the vibration at the bulkhead by the electric field and the deformation of the bulkhead caused by the deformation of the piezoelectric convex portion can also be prevented.

The shape of the ink nozzle 19*a* formed in the nozzle plate 19 may be selected from those in FIGS. 38 (*a*) to (*j*) in accordance with using environments, such as ink conditions.

Although in the above embodiments, the shape of the piezoelectric member 17 has the convex parts 17*a* on the rectangle plate part 17*d*; other shapes of piezoelectric member are applicable as long as a plurality of convex parts are formed on one surface of the piezoelectric member.

In the above embodiments, the ink supplying inlet 35 is provided to the non-piezoelectric member 18, and ink is supplied therefrom to the ink cavity 29 through a hole 24 in the ink cover 20. Besides this, there are various well known configurations for supplying ink to the ink cavity. For example, ink may be supplied from sides of the block plate through an ink supplying tube.

Figure 1:
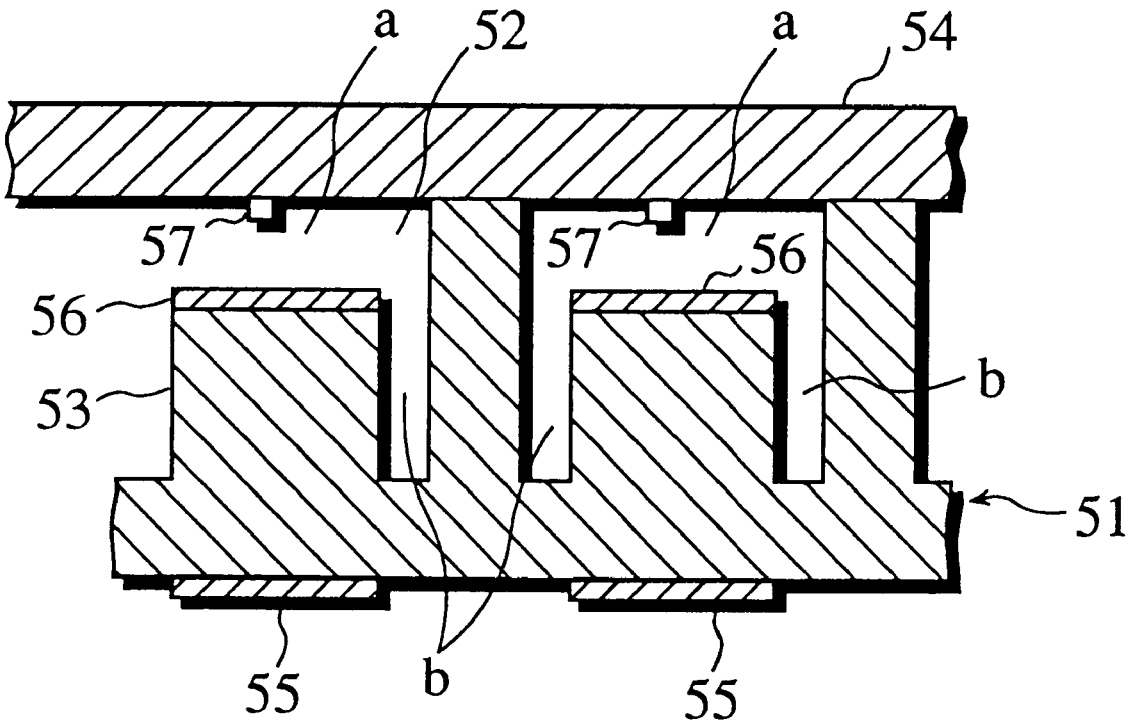
FIG. 1 is a sectional view of a conventional ink jet recording head.

The following effects will be achieved even in the conventional ink jet head shown in FIG. 1 by filling the two grooves b with the filling and adhesive member. By doing so, the ink pressured by deformation of the piezoelectric member cannot enter the grooves b, and deterioration of ink jetting effects can be prevented. Also, drop of bulk resistance caused by entering of ink from the groove b to the piezoelectric bulkhead can be prevented, and drop of effective voltage to the piezoelectric member can be prevented. Further, generation of bubbles caused by cavitation of ink in the groove b upon vibration of the piezoelectric member can be prevented.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A multi-nozzle ink jet head comprising:

a first member including a plurality of first convex parts disposed in line on a part of a surface of the first member, in which at least a part of each of the first convex parts is a piezoelectric element;

a second member made of non-piezoelectric materials, including a plurality of concave parts which correspond to the first convex parts, respectively, and second convex parts each of which have side surfaces and are disposed between adjacent ones of the concave parts, in which the second member is engaged with the first member by inserting each second convex part between a couple of adjacent first convex parts and forming an ink cavity between a bottom of each concave part and a top of a respective first convex part; and a plurality of electrodes being applied to the piezoelectric element included in each of the first convex parts, a plurality of first gaps formed between a top surface of each of the non-piezoelectric second convex parts and the first member and a plurality of second gaps formed between a side surface of each of the non-piezoelectric second convex parts and the first member, and the first gaps and the second gaps are filled with a filling members, wherein said filling member includes a film whereby said first member is engaged with said second member through said film.

2. The multi-nozzle ink jet head of claim 1, wherein when the first convex part is inserted into the non-piezoelectric concave part the first convex part and the non-piezoelectric concave part are movable with respect to each other.

3. The multi-nozzle ink jet head of claim 1, wherein one surface of the first member which includes the convex parts is covered with said film.

4. The multi-nozzle ink jet head of claim 1, wherein the filling member for filling the first gaps includes a filling and adhesive member, the surface of the first member including the first convex parts is covered with said film and the film is adhered to the convex part with the filling and adhesive member, and the first filling member includes a part of the film besides the filling and adhesive member.

5. The multi-nozzle ink jet head of claim 1, wherein the first member includes a base member and a piezoelectric chip which is disposed on the base member, the piezoelectric chip being equivalent to the piezoelectric element.

6. The multi-nozzle ink jet head of claim 5, wherein the electrodes are disposed on surfaces of the corresponding piezoelectric chip, the surfaces opposing to each other.

7. The multi-nozzle ink jet head of claim 6, wherein the piezoelectric chip is a lamination of piezoelectric layers.

8. The multi-nozzle ink jet head of claim 1, wherein the piezoelectric element is made of piezoelectric materials and the first member is an integral unit.

9. The multi-nozzle ink jet head of claim 8, wherein conductive treatment is applied to the first member except the first convex part.

10. The multi-nozzle ink jet head of claim 1, wherein the piezoelectric element included in the first convex part is polarized in a same direction as an electric field formed by applying a voltage across the electrodes with a voltage applying means, and the polarization direction is substantially perpendicular to an ink jetting direction.

11. The multi-nozzle ink jet head of claim 10, wherein a front end of each ink cavity along with the ink jetting direction is covered with a front member in which the ink nozzles are formed, a back end of each ink cavity along with the ink jetting direction is blocked with a block member, and an ink supplying slit communicating with the ink cavity is formed in the second member.

12. The multi-nozzle ink jet head of claim 11, wherein a non-return valve is constructed to the ink supplying slit.

13. A method of producing a multi-nozile ink jet head comprising the steps of:

producing a first member where a plurality of first convex parts are disposed in line, and at least a part of the first convex part is a piezoelectric element;

producing a second member from non-piezoelectric material, which includes a plurality of concave parts corresponding to the first convex parts, respectively, and a second convex part being disposed between adjacent concave parts;

forming a protection layer on one entire surface of the first member which includes all of the first convex parts and spaces therebetween; and engaging the first member and the second member through said protection layer by inserting the first convex parts into respective non-piezoelectric concave parts, and an ink cavity is formed between a top surface of each of the first convex parts and a bottom of the respective non-piezoelectric concave part.

14. The method of claim 13, wherein the step of producing the first member includes a step of laying piezoelectric material on a base member and cutting the piezoelectric material into a predetermined shape so that the piezoelectric elements of the first member are disposed on the base member in line.

15. The method of claim 13, wherein said protective layer is made of insulative material.

16. An ink jet head comprising:

a base plate made of a non-piezoelectric material;

a common electrode disposed on a surface of said base plate;

a plurality of piezoelectric members disposed on a same surface of said common electrode in line, each of said piezoelectric members being spaced from each other; and a cover plate having a surface on which a plurality of concave portions are formed corresponding to said piezoelectric members, respectively, said cover plate being made of a single member, each of said piezoelectric members being integrally inserted into a respective one of said concave parts so that said surface of the cover plate is in contact with said common electrode.

17. The ink jet head as claimed in claim 16 further comprising a plurality of electrodes provided corresponding to said piezoelectric members, respectively.

18. The ink jet head as claimed in claim 16, wherein a space which is formed between a top surface of the piezoelectric member and a bottom surface of the respective one of the concave parts defines an ink cavity.

19. An ink jet head comprising:

a base plate made of a non-piezoelectric material;

a plurality of piezoelectric members disposed on a surface of said base plate in line, each of said piezoelectric members being spaced from each other; and a cover plate having a surface on which a plurality of concave parts are formed corresponding to said piezoelectric members, respectively, said cover plate being made of a single member, all of said piezoelectric members disposed on the surface being integrally inserted into a respective one of said concave parts so that said surface of the cover plate is in direct contact with said base plate.

20. The ink jet head as claimed in claim 19, wherein an adhesive is filled between a side wall of said piezoelectric member and a side wall of the respective one of the concave parts.

21. The ink jet head as claimed in claim 19 further comprising a plurality of electrodes provided corresponding to said piezoelectric members, respectively.

22. The ink jet head as claimed in claim 19, wherein a space which is formed between a top surface of the piezoelectric member and a bottom surface of the respective one of the concave parts defines an ink cavity.

23. An ink jet head comprising:

a first member having a surface on which a plurality of first convex parts are formed in line, at least a part of each of said first convex parts being a piezoelectric element;

a layer which covers said surface and said first convex parts entirely;

a second member made of non-piezoelectric material, having a surface on which a plurality of concave parts are formed corresponding to the first convex parts, respectively, each of said convex parts being inserted into a respective one of said concave parts whereby said first member is engaged with said second member through said layer.

24. The ink jet head as claimed in claim 23 further comprising a plurality of electrodes provided corresponding to said convex parts, respectively.

25. The ink jet head as claimed in claim 23, wherein a space which is formed between a top surface of the convex part and a bottom surface of the respective one of the concave parts defines an ink cavity.

26. The ink jet head as claimed in claim 23, wherein said layer is made of an insulative material.

27. The ink jet head as claimed in claim 26, wherein said layer is a film.

28. The ink jet head as claimed in claim 23, wherein an adhesive is filled between a side wall of said convex part and a side wall of the respective one of said concave parts.

29. An ink jet head comprising:

a first member made of a non-piezoelectric material, said first member of a surface on which a plurality of concave portions and a plurality of convex portions are alternately formed in a predetermined direction;

a single-continuous film which has a first surface and a second surface opposite to said first surface, said first surface being in contact with said convex portions of said first member; and a second member having a base and a plurality of piezoelectric members provided on said base, said piezoelectric members corresponding to said concave portions with respect to said predetermined direction, respectively, each of the piezoelectric members having a portion which is in fixed contact with said second surface of said film over a two dimensional area that exceeds a line contact to confront a respective one of said concave portions through said film, wherein said film is bent into said concave portions by the contact of said convex portions and of said piezoelectric members in a condition where no electrical field is applied to said piezoelectric members.

30. The ink jet head as claimed in claim 29, wherein said film is made of an organic material.

31. The ink jet head as claimed in claim 29, wherein each convex portion is in contact with the base through said film.

32. The ink jet head as claimed in claim 29, wherein said piezoelectric members vibrate when an electric field is applied thereto.

33. The ink jet head as claimed in claim 29, wherein the film is in contact with an apex of each of the piezoelectric members.

34. The ink jet head as claimed in claim 33, wherein the base of the second member is made of a non-piezoelectric material.

35. The ink jet head as claimed in claim 29, wherein the film is in contact with an apex of each of the piezoelectric members.

36. An ink jet head comprising:

a first member made of a non-piezoelectric material, said first member having a surface on which a plurality of concave portions and a plurality of convex portions are alternatively formed in a first direction;

a film which has a first surface and a second surface opposite to said first surface, said first surface being in contact with said convex portions of said first member; and a second member having a base and a plurality of piezoelectric members provided on a surface of said base, said piezoelectric members being aligned in the first direction and protruding from said base in a second direction orthogonal to the first direction, said piezoelectric members corresponding to said concave portions, respectively, each of the piezoelectric members having a width in the first direction and a height in the second direction, the width being shorter than the height, each of the piezoelectric members having a top surface in the second direction which is in contact with said second surface of said film to confront a respective one of said concave portions through said film, wherein said film is bent into said concave portions by the contact of said convex portions and of said tops of said piezoelectric members in a condition where no electrical field is applied to said piezoelectric members.

37. The ink jet head as claimed in claim 36, wherein said film is made of an organic material.

38. The ink jet head as claimed in claim 36, wherein each convex portion is in contact with the base through said film.

39. The ink jet head as claimed in claim 36, wherein said piezoelectric members deforms in the second direction when an electric field is applied thereto.

40. The ink jet head as claimed in claim 36, wherein the film is a single continuous film.

* * * * *